US010863297B2

(12) United States Patent
Cengarle et al.

(10) Patent No.: US 10,863,297 B2
(45) Date of Patent: Dec. 8, 2020

(54) METHOD CONVERTING MULTICHANNEL AUDIO CONTENT INTO OBJECT-BASED AUDIO CONTENT AND A METHOD FOR PROCESSING AUDIO CONTENT HAVING A SPATIAL POSITION

(71) Applicant: DOLBY INTERNATIONAL AB, Amsterdam Zuidoost (NL)

(72) Inventors: Giulio Cengarle, Barcelona (ES); Antonio Mateos Sole, Barcelona (ES)

(73) Assignee: Dolby International AB, Amsterdam Zuidoost (NL)

( * ) Notice: Subject to any disclaimer, the term of this patent is extended or adjusted under 35 U.S.C. 154(b) by 193 days.

(21) Appl. No.: 16/303,415

(22) PCT Filed: May 29, 2017

(86) PCT No.: PCT/EP2017/062848
§ 371 (c)(1),
(2) Date: Nov. 20, 2018

(87) PCT Pub. No.: WO2017/207465
PCT Pub. Date: Dec. 7, 2017

(65) Prior Publication Data

US 2020/0322743 A1 Oct. 8, 2020

Related U.S. Application Data

(60) Provisional application No. 62/371,016, filed on Aug. 4, 2016.

(51) Int. Cl.

| | |
|---|---|
| ***H04S 1/00*** | (2006.01) |
| ***H04S 3/00*** | (2006.01) |
| ***G10L 19/008*** | (2013.01) |

(52) U.S. Cl.
CPC ..... *H04S 1/002* (2013.01); *G10L 19/008* (2013.01); *H04S 3/008* (2013.01)

(58) Field of Classification Search
CPC ..... H04S 1/002; H04S 3/008; G10L 19/008
See application file for complete search history.

(56) References Cited

U.S. PATENT DOCUMENTS

| | | | |
|---|---|---|---|
| 7,974,422 | B1 | 7/2011 | Ho |
| 7,987,096 | B2 | 7/2011 | Kim |

(Continued)

FOREIGN PATENT DOCUMENTS

| | | |
|---|---|---|
| RS | 1332 U | 8/2013 |
| WO | 2008/039039 | 4/2008 |

(Continued)

OTHER PUBLICATIONS

Gorlow, S. et. al., "Multichannel object-based audio coding with controllable quality", 2013 IEEE International Conference on Acoustics, Speech and Signal Processing, Year: 2013, pp. 561-565.

(Continued)

*Primary Examiner* — David L Ton

(57) ABSTRACT

This disclosure falls into the field of object-based audio content, and more specifically it is related to the field of conversion of multi channel audio content into object-based audio content. This disclosure further relates to method for processing a time frame of audio content having a spatial position.

19 Claims, 10 Drawing Sheets

(56) References Cited

U.S. PATENT DOCUMENTS

| | | | | |
|---|---|---|---|---|
| 8,031,883 | B2 | 10/2011 | Bai | |
| 8,086,334 | B2 | 12/2011 | Berchin | |
| 8,296,155 | B2 | 10/2012 | Pang | |
| 8,363,865 | B1 | 1/2013 | Bottum | |
| 8,639,498 | B2 | 1/2014 | Beack | |
| 8,655,145 | B2 | 2/2014 | Yahata | |
| 8,755,543 | B2 | 6/2014 | Chabanne | |
| 8,762,157 | B2 | 6/2014 | Kim | |
| 8,824,688 | B2 | 9/2014 | Schreiner | |
| 9,105,264 | B2 | 8/2015 | Ishikawa | |
| 9,165,558 | B2 | 10/2015 | Dressler | |
| 9,204,236 | B2 | 12/2015 | Tsingos | |
| 2009/0210239 | A1 | 8/2009 | Yoon | |
| 2012/0206651 | A1 | 8/2012 | Minoda | |
| 2013/0170651 | A1* | 7/2013 | Lee | H04R 3/12 381/20 |
| 2014/0023196 | A1 | 1/2014 | Xiang | |
| 2014/0297294 | A1 | 10/2014 | Kim | |
| 2015/0025664 | A1 | 1/2015 | Cory | |
| 2015/0146873 | A1 | 5/2015 | Chabanne | |
| 2015/0208190 | A1 | 7/2015 | Hooks | |
| 2015/0228286 | A1 | 8/2015 | Hooks | |
| 2015/0271620 | A1 | 9/2015 | Lando | |
| 2015/0304791 | A1 | 10/2015 | Crockett | |
| 2015/0332680 | A1 | 11/2015 | Crockett | |
| 2015/0350804 | A1 | 12/2015 | Crockett | |
| 2016/0014516 | A1 | 1/2016 | Tang | |
| 2016/0150343 | A1 | 5/2016 | Wang | |

FOREIGN PATENT DOCUMENTS

| | | |
|---|---|---|
| WO | 2014/165326 | 10/2014 |
| WO | 2015/006112 | 1/2015 |
| WO | 2015/017235 | 2/2015 |
| WO | 2016/014815 | 1/2016 |
| WO | 2016/018787 | 2/2016 |
| WO | 2016/106145 | 6/2016 |

OTHER PUBLICATIONS

Breebaart, J., et. al., "Spatial Audio Object Coding (SAOC)—The Upcoming MPEG Standard on Parametric Object Based Audio Coding", May 1, 2008, Google Scholar, AES Convention:124 (May 2008) Paper No. 7377.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al "Designing of TSS Halls" 13th International Congress on Acoustics, Yugoslavia, 1989.

Stanojevic, T. et al "The Total Surround Sound (TSS) Processor" SMPTE Journal, Nov. 1994.

Stanojevic, T. et al "The Total Surround Sound System", 86th AES Convention, Hamburg, Mar. 7-10, 1989.

Stanojevic, T. et al "TSS System and Live Performance Sound" 88th AES Convention, Montreux, Mar. 13-16, 1990.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, Tomislav "Surround Sound for a New Generation of Theaters, Sound and Video Contractor" Dec. 20, 1995.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

* cited by examiner

METHOD CONVERTING MULTICHANNEL AUDIO CONTENT INTO OBJECT-BASED AUDIO CONTENT AND A METHOD FOR PROCESSING AUDIO CONTENT HAVING A SPATIAL POSITION

TECHNICAL FIELD

This disclosure falls into the field of object-based audio content, and more specifically it is related to the field of conversion of multi channel audio content into object-based audio content. This disclosure further relates to method for processing a time frame of an audio content having a spatial position.

BACKGROUND ART

In recent years, new ways of producing and rendering audio content have emerged. By providing object-based audio content to home theatres and cinemas, the listening experience has improved since sound designers and artists are free to mix audio in a 3D space, steering effects through surround channels and adding a seamless overhead dimension with height channels. Traditionally, audio content of multi-channel format (stereo, 5.1, 7.1, etc.) are created by mixing different audio signals in a studio, or generated by recording acoustic signals simultaneously in a real environment. The mixed audio signal or content may include a number of different sources. Source separation is a task to identify information of each of the sources in order to reconstruct the audio content, for example, by a mono signal and metadata including spatial information, spectral information, and the like By providing tools for transforming legacy audio content, i.e. 5.1 or 7.1 content, to object-based audio content, more movie titles may take advantage of the new ways of rendering audio. Such tools extract audio objects from the legacy audio content by applying source separation to the legacy audio content.

However, there are cases when re-rendering such objects to layouts similar to the original layout of the legacy audio content, e.g. a 5.1 layout or a 7.1 layout, would lead to clear violations of the original intention of the mixer, since the re-rendered audio object is rendered in different channels than initially intended by the mixer of the legacy audio content.

Moreover, after a few years of content production in object-based formats, some mixing techniques have become popular among professionals as a way of achieving aesthetical results that exploit the creative potential offered by these new formats. However, further methods for providing improved artistic control over audio content having a spatial position are needed to further exploit the creative potential of such audio content.

It is within this context that the present disclosure lies.

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DETAILED DESCRIPTION

Figure 1A:
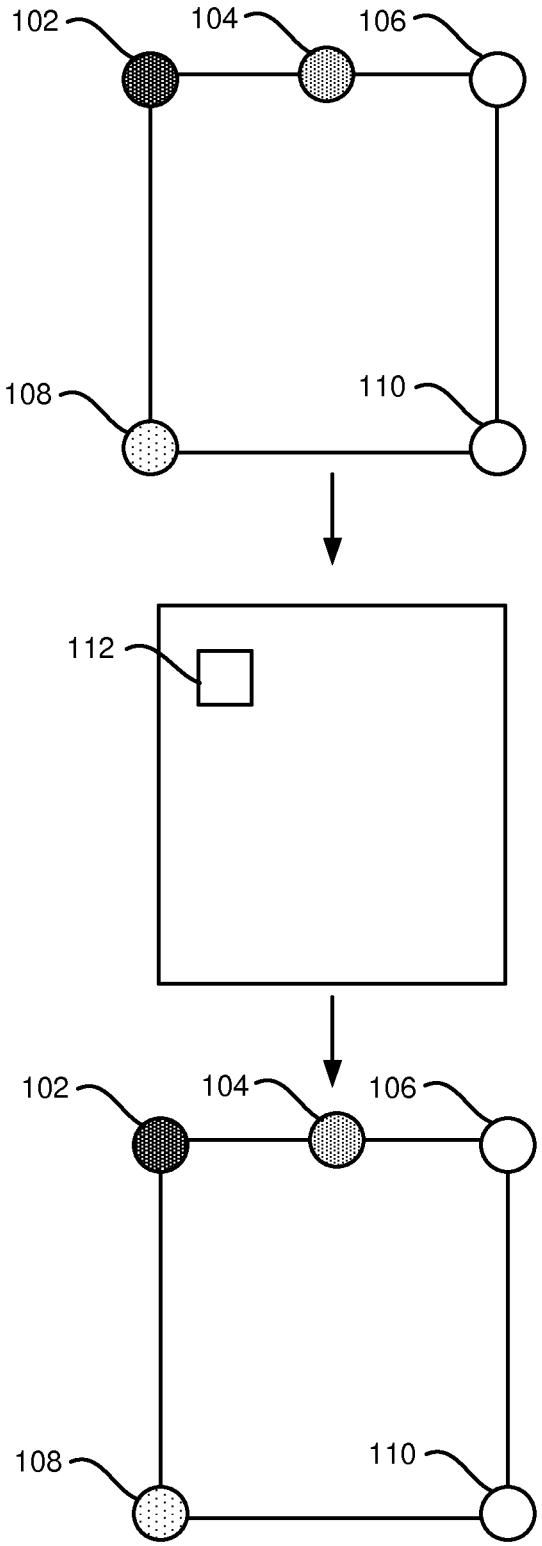
FIG. 1*a* shows a first example of object extraction from a multichannel audio signal with channels in a first configuration, and rendering of the extracted audio object back to a multichannel audio signal with channels in the first configuration.

In view of the above it is an object to provide methods, devices and computer program products for converting a time frame of a multichannel audio signal into object-based audio content which reduces the risk of rendering the audio object in different channels compared to what was initially intended by the mixer of the multichannel audio signal.

It is further an object to provide methods, devices and computer program products for providing improved artistic control over object-based audio content.

I. Overview—Converting Multichannel Audio Content into Object-Based Audio Content According to a first aspect, example embodiments propose methods for converting a time frame of a multichannel audio signal into output audio content comprising audio objects, devices implementing the methods, and computer program product adapted to carry out the method. The proposed methods, devices and computer program products may generally have the same features and advantages.

According to example embodiments there is provided a method for converting a time frame of a multichannel audio signal into output audio content comprising audio objects, metadata comprising a spatial position for each audio object, and bed channels, wherein the multichannel audio signal comprises a plurality of channels in a first configuration, each channel in the first configuration having a predetermined position pertaining to a loudspeaker setup and defined in a predetermined coordinate system, the method comprising the steps of:

a) receiving the time frame of the multichannel audio signal (e.g., receiving the multichannel audio signal), b) extracting at least one audio object from the time frame of the multichannel audio signal, wherein the audio object is extracted from a specific subset of the plurality of channels, and for each audio object of the at least one audio object:

c) estimating a spatial position of the extracted audio object, d) based on the spatial position of the extracted audio object, estimating a risk that a rendered version of the audio object in channels in the first configuration will be rendered in channels with predetermined positions differing from the predetermined positions of the specific subset of the plurality of channels from which the object was extracted, e) determining whether the risk exceeds a threshold, f) upon determining that the risk does not exceed the threshold, include the audio object and metadata comprising the spatial position of the audio object in the output audio content (e.g., output audio object content).

The method may further comprise, upon determining that the risk exceeds the threshold, rendering at least a fraction (e.g., non-zero fraction) of the audio object to the bed channels.

The method may further comprise, upon determining that the risk exceeds the threshold, processing the audio object and the metadata comprising the spatial position of the audio object to preserve artistic intention (e.g., by providing said audio object and said metadata to an artistic preservation stage).

For example, the multichannel audio signal may be configured as a 5.1-channel set-up or a 7.1-channel set-up, which means that each channel has a predetermined position pertaining to a loudspeaker setup for this configuration. The predetermined position is defined in a predetermined coordinate system, i.e. a 3d coordinate system having an x component, a y component and a z component. The predetermined coordinate system may correspond to a possible range for the x component, the y component and the z component which is $0<=x<=1$, $0<=y<=1$, $0<=z<=1$. As understood by the skilled person, any other range for the components of the coordinate system is equally possible, such as $0<=x<=20$, $0<=y<=54$, $0<=z<=1$ or $0<=x<=96$, $0<=y<=48$, $0<=z<=12$ etc. The possible ranges are irrelevant, but for simplicity, the coordinate system in this disclosure is normalized to the above range of $0<=x<=1$, $0<=y<=1$, $0<=z<=1$.

By a bed channel is generally meant an audio signal which corresponds to a fixed position in the three-dimensional space (predetermined coordinate system), always equal to the position of one of the output speakers of the corresponding canonical loudspeaker setup. A bed channel may therefore be associated with a label which merely indicates the predetermined position of the corresponding output speaker in a canonical loudspeaker layout.

The extraction of objects may be realized e.g. by the Joint Object Source Separation (JOSS) algorithm developed by Dolby Laboratories, Inc. In summary such extraction may comprise performing an analysis on the audio content (e.g., using Principal Component Analysis (PCA)) for each of the plurality of channels to generate a plurality of components, each of the plurality of components comprising a plurality of time-frequency tiles in the time-frequency domain; generating at least one dominant source with at least one of the time-frequency tiles from the plurality of the components; and separating the sources from the audio content by estimating spatial parameters and spectral parameters based on the dominant source. A multi-channel audio signal can thus be processed into a plurality of mono audio components (e.g., audio objects) with metadata such as spatial information (e.g., spatial position) of sources. Any other suitable way of source separation may be used for extracting the audio object.

The inventors have realized that when transforming legacy audio content, i.e. channel-based audio content, to audio content comprising audio objects, which later may be rendered back to a legacy loudspeaker setup, i.e. a 5.1-channel set-up or a 7.1-channel set-up, the audio object, or the audio content of the audio object, may be rendered in different channels compared to what was initially intended by the mixer of the multichannel audio signal. This is thus a clear violation of what was intended by the mixer, and may in many cases lead to a worse listening experience.

By estimating a risk that the rendered version of the audio object in channels in the first configuration will be rendered in other channels, and thus in other speakers, than initially intended by the mixer, and determining whether the risk exceeds a threshold, prior to taking the decision if the audio object and its corresponding metadata should be included as is in the output audio content, or if the audio object should be handled differently, the risk of faulty rendering of the audio object may be reduced. Such estimation is advantageously done based on the estimated spatial position of the audio object, since specific areas or positions in the three-dimensional space often means an increased (or decreased risk) of faulty rendering.

By the term "estimating a risk" should, in the context of present specification, be understood that this could result in for example a binary value (0 for no risk, 1 for risk) or a value on a continuous scale (e.g., from 0-1 or from 0-10 etc.). In the binary case, the step of "determining whether the risk exceeds a threshold" may mean that it is checked if the risk is 0 or 1, and if it is 1, the risk exceeds the threshold. In the continuous case, the threshold may be any value in the continuous scale depending on the implementation.

The number of audio objects to extract may be user defined, or predefined, and may be 1, 2, 3 or any other number.

According to some embodiments, the step of estimating a risk comprises the step of: comparing the spatial position of the audio object to a predetermined area. In this case, the risk is determined to exceed the threshold if the spatial position is within the predetermined area. For example, and an audio object positioned in an area along or near a wall (i.e., an outer bounds in the three-dimensional space of the predetermined coordinate system) which comprises more than two speaker may increase the risk of faulty rendering of the audio object if re-rendered in a legacy audio system. In other words, areas along or near a wall which comprises more than two predetermined positions for channels in the multichannel audio signal may be a such a predetermined area. In yet other words, the predetermined area may include the predetermined positions of at least some of the plurality of channels in the first configuration. In this case, every audio object with its spatial position within this predetermined area may be labeled as a risky audio object for faulty rendering, and thus not directly included, with its corresponding metadata, as is in the output audio content. The above two embodiments are advantageous in that they are very simple and cost efficient (in terms of computational complexity) ways of determining whether the risk exceeds the threshold or not.

According to some embodiments, the first configuration corresponds to a 5.1-channel set-up or a 7.1-channel set-up, wherein the predetermined area includes the predetermined positions of a front left channel, a front right channel, and a center channel in the first configuration. An area close to the screen may thus be an example of a risky area. For example, an audio object positioned on top of the center channel may originate by 50% from the front left channel and by 50% from the front right channel in the multichannel audio signal, or by 50% from the center channel, by 25% from the front left channel and by 25% from the front right channel in the multichannel audio signal etc. However, when the audio object later is rendered in a 5.1-channel set-up legacy system or a 7.1-channel set-up legacy system it may end up in only the center channel, which would violate the initial intentions of the mixer and may lead to a worse listening experience.

According to some embodiments, the predetermined positions of the front left, front right and center channels share a common value of a given coordinate (e.g., y-coordinate value) in the predefined coordinate system, wherein the predetermined area includes positions having a coordinate value of the given coordinate (e.g., y-coordinate value) up to a threshold distance away from said common value of the given coordinate (e.g., y-coordinate).

As described above, the front left, front right and center channels could share another common coordinate value such as an x-coordinate value or a z-coordinate value in case the predetermined coordinate system are e.g. rotated or similar.

According to this embodiment, the predetermined area may thus stretch a bit away from the screen area. In other words, the predetermined area may stretch a bit away from the common plane in the three-dimensional space on which the front left, front right and center channels will be rendered in the a 5.1-channel loudspeaker setup or a 7.1-channel loudspeaker setup. In this way, audio objects with spatial positions within this predetermined area may be handled differently based on how far away from the common plane their positions lay. However, audio objects outside the predetermined area will in any case be included as is in the output audio content along with their respective metadata comprising the spatial position of the respective audio object.

According to some embodiments, the predetermined area comprises a first sub area, the method further comprises the step of:

determining a fraction value corresponding to a fraction of the audio object to be included in the output audio content (e.g., output audio object content) based on a distance between the spatial position and the first sub area, wherein the value is a number between 0 and 1. For example, the fraction value may be smaller than one if the risk is determined to exceed the threshold (e.g., in case the spatial position is within the predetermined area). Further, the fraction value may be zero if the spatial position is within the first sub area.

For this embodiment, if the fraction value is determined to be more than zero, the method further comprises:

multiplying the audio object with the fraction value to achieve a fraction of the audio object, and including the fraction of the audio object and metadata comprising the spatial position of the audio object in the output audio content.

By calculating a fraction of the object within the area to be included in the output audio object content, a more continuous transition between including nothing of the audio object and metadata directly in the output audio object content and including the entire audio object and metadata in the output audio object content is achieved. This in turn may lead to a more smooth listening experience for e.g. object moving within the predetermined area away from the first sub area during a time period of the multi channel audio signal. According to some embodiments, the determination of the fraction value is only made in case the risk is determined to exceed the threshold (e.g., in case the spatial position is within the predetermined area). According to other embodiments, in case the spatial position is not within the predetermined area, the fraction value will be 1. For example, the fraction value is determined to be 0 if the spatial position is in the first sub area, is determined to be 1 if the spatial position is not in the predetermined area, and is determined to be between 0 and 1 if the spatial position is in the predetermined area but not in the first sub area.

The first sub area may for example correspond to the common plane in the three-dimensional space on which the front left, front right and center channels will be rendered in the a 5.1-channel loudspeaker setup or a 7.1-channel loudspeaker setup. This means that audio objects extracted in the screen will be muted (not included in the output audio object content), objects far from the screen will be unchanged (included as is in the output audio object content), and objects in the transition zone will be attenuated according to the value of the fraction value or according to a value depending on the fraction value, such as the square root of the fraction value. The latter may be used to follow a different normalization scheme, e.g. preserving energy sum of object/channel fractions instead of preserving amplitude sum of object/channel fractions.

According to some embodiments, the remainder of the audio object, i.e., the audio object multiplied by 1 minus the fraction value, may be rendered to the channel beds. Alternatively, it may be included in the output audio content together with metadata (e.g., metadata comprising the spatial position of the audio object) and additional metadata (described below).

According to some embodiments, the step of extracting at least one audio object from the multichannel audio signal comprises, for each extracted audio object, computing a first set of energy levels, each energy level corresponding to a specific channel of the plurality of channels of the multichannel audio signal and relating to (e.g., indicating) an energy level of audio content of the audio object that was extracted from the specific channel, wherein the step of estimating a risk comprises the steps of:

using the spatial position of the audio object, rendering the audio object to a second plurality of channels in the first configuration and computing a second set of energy levels based on the rendered object, each energy level corresponding to a specific channel of the second plurality of channels in the first configuration and relating to (e.g., indicating) an energy level of audio content of the audio object that was rendered to the specific channel of the second plurality of channels, calculating a difference between the first set of energy levels and the second set of energy levels, and estimating the risk based on the difference.

In other words, in the present embodiment the extracted audio object in its original format (e.g., 5.1/7.1) in the multichannel audio signal is compared with a rendered version in the original layout (e.g., 5.1/7.1). If the two versions are similar, allow object extraction as intended; otherwise, handle the audio object differently to reduce the risk of faulty rendering of the audio object. This is a flexible and exact way of determining if an audio object will be faulty rendered or not and applicable on all configurations of the multichannel audio signal and spatial positions of the extracted audio object. For example, each energy level of the first set of energy levels may be compared to the corresponding energy level among the second set of energy levels. In the case the energy levels (or the RMS) are normalized across the set such that the total energy level (or the RMS) is one in each set, the threshold may for example be 1

The computed first set of energy level should be interpreted as follows. Each energy level, or squared panning parameter, relates to the energy level of the audio content of the audio object that was extracted from a specific channel. For example, if the audio object is extracted from two out of the five channels in a 5.1 setup (e.g., L-channel and the C-channel), but most of the content in the audio object was extracted from the L-channel, the squared panning parameters may look like L=0.8, C=0.4, R=0 etc.

The difference of the value of the squared panning parameter (energy level) of the L-channel (0.8) and the value of the squared panning parameter (energy level) of the C-channel (0.4) in this case means that the energy level of the audio content, of the extracted audio object, extracted from the L-channel had twice the energy level compared to the audio content of the audio object which was extracted from the C-channel.

According to some embodiments, the step of calculating a difference between the first set of energy levels and the second set of energy levels comprises: using the first set of energy levels, rendering the audio object to a third plurality of channels in the first configuration, for each pair of corresponding channels of the third and second plurality of channels, measuring a Root-Mean-Square, RMS, value of each of the pair of channels, determining an absolute difference between the two RMS values, and calculate a sum of the absolute differences for all pairs of corresponding channels of the third and second plurality of channels, wherein the step of determining whether the risk exceeds a threshold comprises comparing the sum to the threshold. In the case the energy levels, or the RMS, are normalized across the channels such that their sum, or the sum of the RMS, is one, the threshold may for example be 1.

According to some embodiments, the step of extracting at least one audio object from the multichannel audio signal comprises, for each extracted audio object, computing a first set of energy levels, each energy level corresponding to a specific channel of the plurality of channels of the multichannel audio signal and relating to (e.g., indicating) an energy level of audio content of the audio object that was extracted from the specific channel, the method further comprising the step of: upon determining that the risk exceed the threshold, using the first set of energy levels for rendering the audio object to the output bed channels.

The present embodiment specifies an example of how to handle audio objects that are determined to be in the danger-zone for being faulty rendered. By utilizing the bed channels in the output audio content (i.e., the output bed channels), the audio content of the audio object can be included in the output audio content in a similar way as it was received in the multichannel audio signal. In other words, if the extracted object is detected as violating an artistic intention (e.g., by the methods of any of the above embodiments), the content can be kept as a channel-based signal in the same format as in the input signal, and sent to the output bed channels. All that is needed is to apply the panning parameters (e.g., energy levels) to the extracted object, obtain the multichannel version of the object, and add it to the output bed channels. This is a simple way of making sure that the audio content of the audio object will be rendered as intended by the mixer of the multichannel audio signal.

According to some embodiments, the method further comprises the steps of multiplying the audio object with 1 minus the fraction value to achieve a second fraction of the audio object, and using the first set of energy levels for rendering the second fraction of the audio object to the output bed channels. In other words, the audio content of the fraction of the audio object not included in the output audio content as described above is instead included in the output bed channels.

According to some embodiments, the method further comprises the step of, upon determining that the risk exceeds the threshold, including in the output audio content: the audio object, metadata comprising the spatial position of the audio object and additional metadata, wherein the additional metadata is configured so that it can be used at a rendering stage to ensure that the audio object is rendered in channels in the first configuration with predetermined positions corresponding to the predetermined positions of the specific subset of the plurality of channels from which the object was extracted.

According to some embodiments, the method further comprises the steps of: including in the output audio content: the audio object, metadata comprising the spatial position of the audio object and additional metadata, wherein the additional metadata indicates at least one from the list of:

- the specific subset of the plurality of channels from which the object was extracted,
- at least one channel of the plurality of channels which is not included in the specific subset of the plurality of channels from which the object was extracted, and
- a divergence parameter.

If an audio object is determined to be in the danger zone of being faulty rendered, it can be included as a special audio object in the output audio content, with additional metadata. The additional metadata can then be used by a renderer to render the audio object in the channels initially intended by the mixer of the multichannel audio signal. For example, the additional metadata can comprise the panning parameters, or energy levels, each energy level corresponding to a specific channel of the plurality of channels of the multichannel audio signal and relating to (e.g., indicating) an energy level of audio content of the audio object that was extracted from the specific channel.

In some embodiments, the additional metadata is included in the output audio content only upon determining that the risk exceeds the threshold.

In other embodiments, the additional metadata comprises a zone mask, e.g. data pertaining to at least one channel of the plurality of channels which is not included in the specific subset of the plurality of channels from which the object was extracted. In yet other embodiments, the additional metadata may comprise a divergence parameter, which e.g. may define how large part of an audio object positioned near or on the predetermined position of the center channel in the first configuration that should be rendered in the center channel, and thus implicitly how large part that should be rendered in the left and right channel.

According to some embodiments, the step of extracting at least one audio object from the multichannel audio signal comprises, for each extracted audio object, computing the first set of energy levels, each energy level corresponding to a specific channel of the plurality of channels of the multichannel audio signal and relating to (e.g., indicating) an energy level of audio content of the audio object that was extracted from the specific channel. In this case, upon determining that the risk exceeds the threshold, the method further comprises the steps of:

using the first set of energy levels for rendering the audio object to a second plurality of channels in the first configuration, subtracting audio components of the second plurality of channels from audio components of the first plurality of channels, and obtaining a time frame of a third multichannel audio signal in the first configuration, extracting at least one further audio object from the time frame of the third multichannel audio signal, wherein the further audio object being extracted from a specific subset of the plurality of channels of the third multichannel audio signal, performing step c)-f) as described above on each further audio object of the at least one further audio object.

Each further audio object may then be handled as described in any of the embodiments above.

In other words, the methods described above may be performed iteratively on the remaining multi channel audio signal when a first audio object has been extracted, to extract further audio objects and check if those should be included in the output audio content as is, or if they should be handled differently.

According to some embodiments, an iteration comprises extracting a plurality of audio objects (for example 1, 2, 3, or 4) from the multichannel audio signal. It should be understood that in these cases, the methods described above are performed on each of the extracted audio objects.

According to some embodiments, wherein yet further audio objects are extracted as described above, until at least one stop criteria of the following list of stop criterion is met:

a energy level of an extracted further object is less than a first threshold energy level, a total number of extracted objects exceed a threshold number, and a energy level of the obtained time frame of the difference multichannel audio signal is less than a second threshold energy level.

In other words, any of the methods above may be performed iteratively until one of these stop criteria is met. This may reduce the risk of extracting an audio object with a small energy level which may not improve the listening experience since a person will not perceive the audio content as a distinct object when playing e.g. the movie.

In the above embodiments, individual audio objects or sources are extracted from the direct signal (multichannel audio signal). The contents that are not suitable to be extracted as objects are left in the residual signal which is then passed to the bed channels as well. The bed channels are often in a similar configuration as the first configuration, e.g. a 7.1 configuration or similar wherein new content added to the channels are combined with the any already existing content of the bed channels.

According to example embodiments there is provided a computer program product comprising a computer-readable storage medium with instructions adapted to carry out the method of the first aspect, when executed by a device having processing capability.

According to example embodiments there is provided a device for converting a time frame of an multichannel audio signal into output audio content comprising audio objects, metadata comprising a spatial position for each audio object, and bed channels, wherein the multichannel audio signal comprises a plurality of channels in a first configuration, each channel in the first configuration having a predetermined position pertaining to a loudspeaker setup and defined in a predetermined coordinate system, the device comprises:

a receiving stage arranged for receiving (e.g., configured to receive) the multichannel audio signal, an object extraction stage arranged for extracting (e.g., configured to extract) an audio object from the time frame of the multichannel audio signal, the audio object being extracted from a specific subset of the plurality of channels, a spatial position estimating stage arranged for estimating (e.g., configured to estimate) a spatial position of the audio object, a risk estimating stage arranged for, based on the spatial position of the audio object, estimating (e.g., configured to estimate) a risk that a rendered version of the audio object in channels in the first configuration will be rendered in channels with predetermined positions differing from the predetermined positions of the specific subset of the plurality of channels from which the object was extracted, and determining whether the risk exceeds a threshold, a converting stage arranged for, in response to the risk estimating stage determining that the risk does not exceed the threshold, including (e.g., configured to include) the audio object and metadata comprising the spatial position of the audio object in the output audio object content.

II. Overview—Processing an Audio Object

According to a second aspect, example embodiments propose methods for processing a time frame of audio content having a spatial position, devices implementing the methods, and computer program product adapted to carry out the method. The proposed methods, devices and computer program products may generally have the same features and advantages.

According to example embodiments there is provided a method for processing a time frame of audio content having a spatial position, comprising the steps of:

determining the spatial position of the audio content, determining a distance value by comparing the spatial position of the audio content to a predetermined area, wherein the spatial position of the audio content is a coordinate in 3D having an x component, a y component and a z component, wherein a possible range of the spatial position of the audio content is $0<=x<=1$, $0<=y<=1$ and $0<=z<=1$, wherein the predetermined area corresponds to coordinates in the range of $0<=x<=1$, $y=0$ and $0<=z<=1$, wherein the step of determining a distance value comprises using the y component of the spatial position as the distance value, determining, at least based on the spatial position of the audio content, whether properties of the audio content should be adjusted, upon determining that properties of the audio content should be adjusted, receiving a control value and adjusting at least one of the spatial position and an energy level of the audio content at least based on the distance value and the control value.

The coordinate system in this embodiment is normalized for ease of explanation, and thus encompasses any suitable coordinate system and ranges of the component of the coordinate system.

It is desirable to enable a processing chain that modifies properties of an audio content having a spatial position to enable artistic control over the final mix. The direct manipulation of each individual audio object or a channel based on its canonical positions (i.e., audio content having a spatial position), is, in many cases, not viable (objects too unstable and/or with too much leakage from others, or simply too time-consuming).

The inventors have realized that it would be advantageous to provide high-level controls to the mixer, controlling intuitive, high-level parameters that can vary over time and can either be controlled manually or pre-set, or inferred automatically based on the characteristics of the content of the audio objects.

By adjusting properties of audio content based on its spatial position, and distance to a predetermined area within the three-dimensional space, easy to use and intuitive controls can be achieved. Adjustment of the spatial position and/or the energy level of the audio content is advantageous in that the result of such adjustments are simple to predict and thus intuitive. By also including a control value, a single parameter may control the extent of the adjustment, which can be compared with turning on a knob on a mixer board. Consequently, if the control value is zero, no adjustment is made. If the control value is at its max value (e.g., 1 in case of a normalized control value, but any other range of control values may be possible such as 0-10), full adjustment of the property/properties of the audio content based on the distance value is made.

The control value may thus be user defined according to some embodiments. However, the control value may also be automatically generated by analyzing the audio content. For example, certain adjustments may only be suitable for music content, and not for dialogue content. In this example, a dialogue detection stage and a music detection stage may be adapted to set the control value, increasing the adjustments (increased control value) when music and no dialogue are detected, and setting the control value to 0 when dialogue is detected which will lead to no adjustments as described above.

It should be noted that the embodiments for processing a time frame of audio content need not to be applied to all audio objects and/or channels in e.g. an input audio content. Typically, one a subset of the audio objects is subjected to the methods described herein. For example, audio objects relating to dialog are not subjected, but instead kept as is. According to some embodiments, only (a subset of) audio objects in the input audio content are subjected, while any channels-based audio content (e.g., bed channels) are left as is.

According to some embodiments, the properties of the audio content is determined to be adjusted if the distance value does not exceed a threshold value, wherein upon determining that properties of the audio content should be adjusted, the spatial position is adjusted at least based on the distance value and on the x-value of the spatial position.

With this embodiment, the spatial position of audio content can be adjusted based on if it is near the screen, and based on where in the room it is positioned in an x-direction. This embodiment may for example be used for achieving a spread out effect of audio objects near a specific area such as the screen which for example may have the effect that other sounds on screen (dialogue, effects, etc.) are more intelligible because spatial masking is reduced.

According to some embodiments, the step of adjusting the spatial position comprises adjusting the z value of the spatial position based on the x-value of the spatial position and adjusting the y value of the spatial position based on the x value of the spatial position. With this embodiment, e.g. audio objects and/or bed channels on screen may be mapped to an arc encompassing the screen from front left channel and front right channel. The control value may control the amount of spread. If the control value is set to zero, the function doesn't affect the content. The effect is thus achieved by modifying audio content position (e.g., spatial position of an audio object or canonical position of a channel).

According to some embodiments, wherein the properties of the audio content is determined to be adjusted only if the distance value exceeds a threshold value, wherein upon determining that properties of the audio content should be adjusted, the energy level is adjusted at least based on the distance value and on the z-value of the spatial position. With this embodiment, for example audio objects positioned away from a certain area, e.g. the screen, may be boosted (amplified etc.) based on the height of the spatial position of the audio object. By this embodiment, an improved listening experience may be achieved since the energy level of audio objects/channels e.g. positioned in or near the ceiling are increased. The control value may control the amount of boost permitted.

According to some embodiments, the method comprises the step of, prior to the step of determining whether properties of the audio content should be adjusted, determining a current energy level of the time frame of the audio content, wherein the energy level of the audio content is adjusted also based on the current energy level. For example, subtle audio objects may be boosted more than not subtle audio objects which according to some embodiments should not be boosted at all. For this reason, according to some embodiments, the properties of the audio content is determined to be adjusted only if the current energy level does not exceed a threshold energy level.

According to some embodiments, the method comprises receiving an energy adjustment parameter pertaining to a previous time frame of the audio content, wherein the energy level is adjusted also based on the energy adjustment parameter. Consequently, the boost applied is adaptive to the boost previously applied, to achieve a smoother boosting of the audio content.

According to some embodiments, the properties of the audio content is determined to be adjusted only if the distance value exceeds a threshold value, wherein the z value of the spatial position is adjusted based on the distance value. Accordingly, audio object/channels further from the predefined area (e.g., the screen) may be moved upwards such that a higher fraction of their energy is perceived as coming from the ceiling. For example, the present embodiment may lift audio objects towards the ceiling when they were panned (as an example of being positioned) on the walls in the rear part of the room (as an example of the three-dimensional space).

According to some embodiments, the z value is adjusted to a first value for a first distance value, and to a second value lower than the first value for a second distance value being lower than the first distance value. Accordingly, audio objects/channels further back in the room may be pushed closer to the ceiling compared to objects/channels closer to the screen.

According to example embodiments, there is provided a computer program product comprising a computer-readable storage medium with instructions adapted to carry out the method according to the second aspect when executed by a device having processing capability.

According to example embodiments, there is provided a device for processing a time frame of an audio content, comprising a processor arranged (e.g., configured) to:

determine a spatial position of the audio content, determine a distance value by comparing the spatial position of the audio content to a predetermined area, wherein the spatial position of the audio content is a coordinate in 3D having an x component, a y component and a z component, wherein a possible range of the spatial position of the audio content is 0<=x<=1, 0<=y<1 and 0<=z<=1, wherein the predetermined area corresponds coordinates in the range of 0<=x<=1, y=0 and 0<=z<=1, wherein the step of determining a distance value comprises using the y component of the spatial position as the distance value, determine, at least based on the spatial position of the audio content, whether properties of the audio content should be adjusted, upon determining that properties of the audio content should be adjusted, the processor is arranged to receive a control value and adjust at least one of the spatial position and an energy level of the audio content at least based on the distance value and the control value.

III. Example Embodiments

In the following, the format of output audio content is exemplified as Dolby Atmos content. However, this is just an example and any other object-based sound format may be used.

Figure 17:
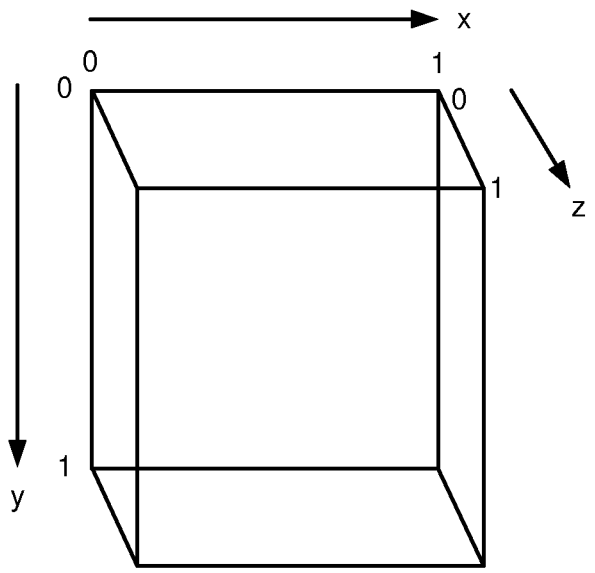
FIG. 17 shows by way of example a coordinate system used in the present disclosure, FIG. 18 show by way of example a device for processing a time frame of an audio object, according to embodiments of the present disclosure.

Also, in the following, the methods, devices and computer-program products are exemplified in a 3D coordinate system having an x component, a y component and a z component, where a possible range for the x component, the y component and the z component which is 0<=x<=1, 0<=y<=1, 0<=z<=1. Here, the x component indicates the dimension that extends from left to right, the y component indicates the dimension that extends from front to back, and the z component indicates the dimension that extends from bottom to top. This coordinate system is shown in FIG. 17. However, any 3D coordinate system is covered by the present disclosure. To adapt such coordinate system to the coordinate system of this disclosure (as shown in FIG. 17), a normalization of the possible ranges for the three coordinates is the only thing needed. In the exemplary coordinate system of FIG. 17, the surface on the top in the drawing, i.e. the plane at y=0, may contain a screen.

Legacy-to-Atmos (LTA) is a content creation tool that takes 5.1 or 7.1 content (which could be a full mix, or parts of it, e.g., stems) and turn this legacy content into Atmos content, consisting of audio objects (audio+metadata) and bed channels. In LTA, objects are extracted from the original mix by applying source separation to the direct component of the signal. Source separation is exemplified above, and will not be discussed further in this disclosure. LTA is just an example and any other method for converting legacy content to an object-based sound format may be used.

Figure 1B:
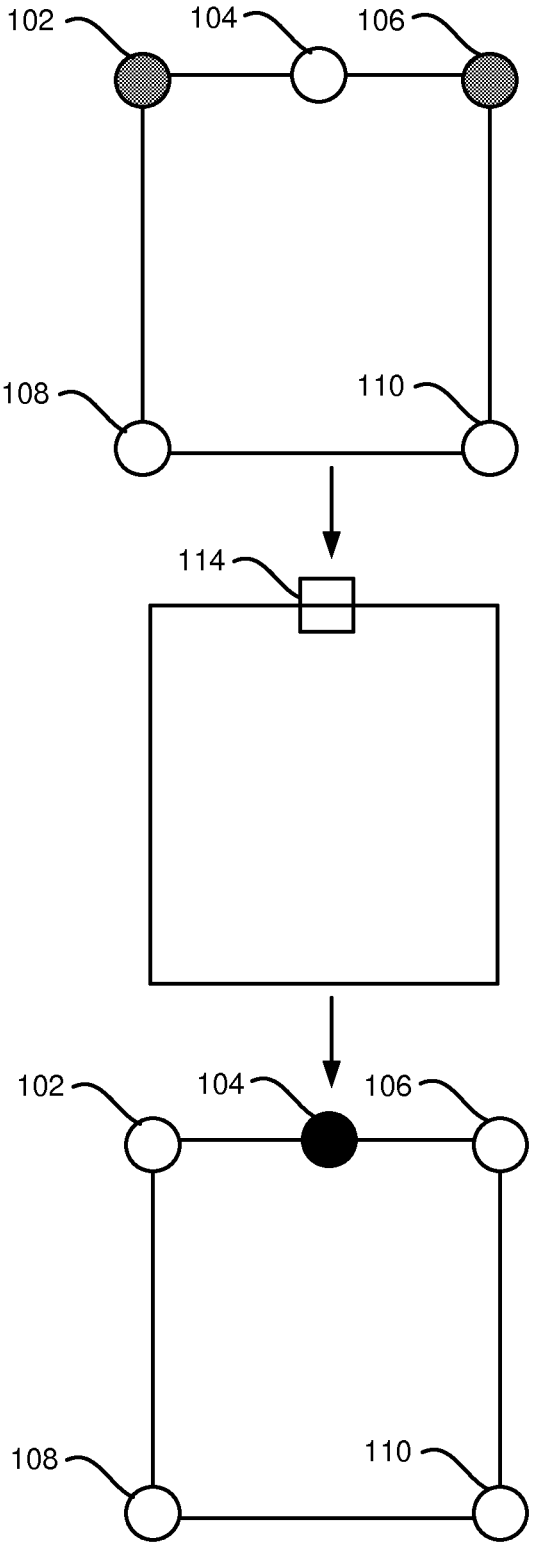
FIG. 1*b* shows a second example of object extraction from a multichannel audio signal with channels in a first configuration, and rendering of the extracted audio object back to a multichannel audio signal with channels in the first configuration.

The spatial position metadata (e.g., in the form of x, y) of extracted objects 112, 114 is estimated from the channel levels, as shown in FIGS. 1*a-b*. In these figures, the circles 102-110 represent the channels of a 5.1 audio signal (which is an example of a multichannel audio signal which comprises a plurality of channels in a first configuration, e.g., a 5.1 channel configuration), and their darkness represents the audio level of each channel. For example, for the audio object 112 in FIG. 1*a*, most of the audio content can be found in the front left channel (L) 102, some of the audio content can be found in the center channel (C) 104 and a little audio content can be found in the rear left channel 108. All channels in such a configuration have a predetermined position pertaining to a loudspeaker setup and defined in a predetermined coordinate system (e.g., as shown in FIG. 17). For example, for the L channel, the predetermined position is x=0, y=0 (and z=0). For the C channel, the predetermined position is x=0.5, y=0 (and z=0) etc.

However, a problem may occur when, after object extraction and metadata estimation, rendering the extracted objects to layouts that are similar to the original 5.1/7.1 layout. Such case is shown in FIG. 1*b*, where a clear violation of the original intention of the mixer can be seen.

For example, consider the following case.

FIGS. 1*a-b* each shows a time frame of a multichannel audio signal for a specific audio object. It should be noted that FIGS. 1*a-b* show the simplified case where only one audio object is included in the multichannel audio signal, for ease of description.

LTA will extract an audio object 112, 114 from the time frame of the multichannel audio signal which have been received by the content creation tool (e.g., a device for converting a time frame of a multichannel audio signal into output audio content). The audio objects 112, 114 are extracted from a specific subset of the plurality of channels, e.g. the subset of the front left channel 102, the center channel 104 and the rear left channel 108 for FIG. 1*a*, and the front left channel 102 and the front right channel (R) in FIG. 1*b*. A spatial position for each audio object 112, 114 is estimated and shown in the by the squares 112, 114 in FIGS. 1*a-b*.

However, when the output of LTA (the audio objects 112, 114) is rendered, in this case, to the original 5.1 layout, the result differs as can be seen in the lower part of FIGS. 1*a-b*.

For the case in FIG. 1*a*, the result obtained for the rendered audio object 112 is identical (or very similar) to the originally received time frame of the multichannel audio signal.

For the case in FIG. 1*b*, the audio object 114 that was originally intended to be located in the centre by phantom imaging (i.e., by using only the front left channel 102 and front right channel 106), is now fully rendered to the center channel 104, irrespective of the initial artistic intention by the mixer that prevented it to activate the centre speaker. This is an example of violating the original artistic intention, potentially leading to a significantly degraded listening experience.

Throughout this document, we define "artistic intention" as the decision of using a specific subset of available channels for rendering an object, and/or the decision of not using a specific subset of available channels for rendering an object. In other words, when artistic intention is violated, a rendered version of the audio object in channels in the first configuration will be rendered in channels with predetermined positions differing from the predetermined positions of the specific subset of the plurality of channels from which the object was extracted. For example, as shown in FIG. 1*b*, the artistic intention was to render the audio object with 50% at position x=0, y=0, and with 50% at position x=1, y=0 while the actual outcome was 100% at position x=0.5, y=0.

Typical examples of artistic intentions are:

Panning a source on the screen using only L channel and R channel (not using C channel).

Panning a source front-to-back in 7.1 layout using only L channel and left rear surround (Lrs) channel, R channel and right rear surround (Rrs) channel and not using left side surround (Lss) channel and right side surround (Rss) channel.

Consequently, the audio objects which are in risk of being faulty rendered should be handled differently to reduce the risk of such violation. As such, only audio objects not in risk (or with a risk below a certain threshold) of being faulty rendered should be included in the output audio object content in a normal way, i.e. as audio content and metadata comprising the spatial position of the audio object.

Figure 2:
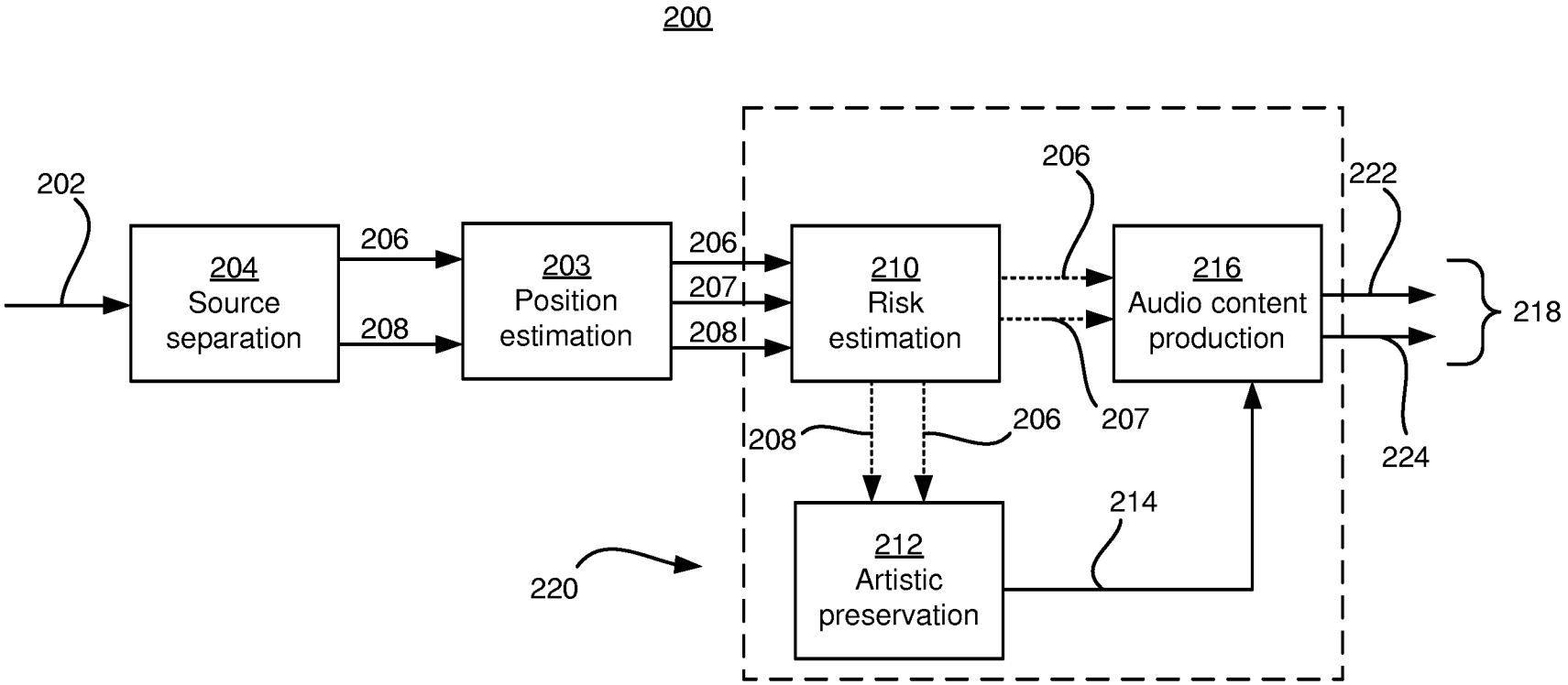
FIG. 2 shows a device for converting a time frame of an multichannel audio signal into output audio content comprising audio objects, metadata comprising a spatial position for each audio object, and bed channels, according to embodiments of the disclosure.
Figure 16:
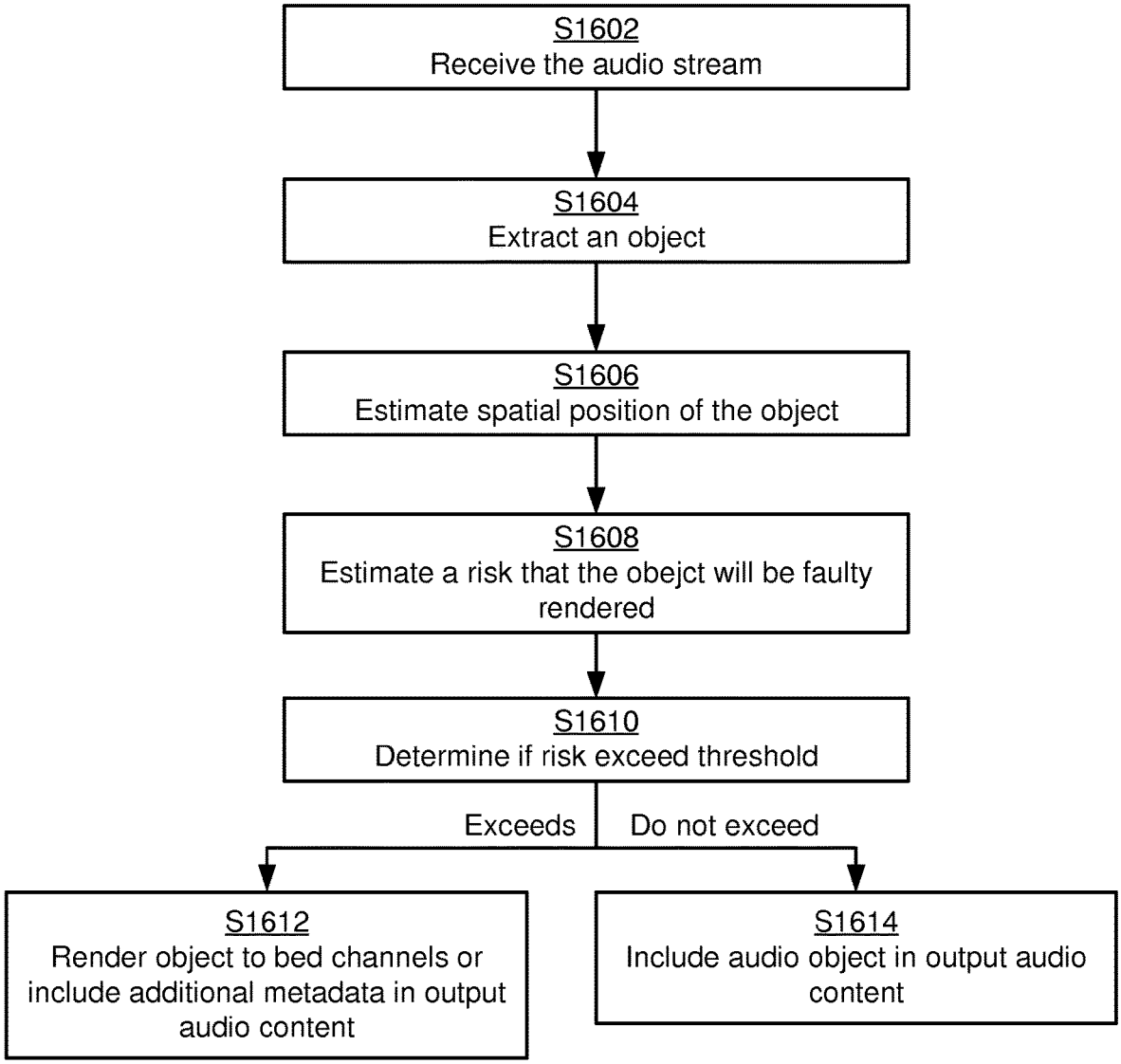
FIG. 16 shows a method for converting a time frame of a multichannel audio signal into output audio content comprising audio objects according to embodiments of the disclosure.

A device and method for converting a time frame of a multichannel audio signal into output audio content comprising audio objects, metadata comprising a spatial position for each audio object, and bed channels, will now be described by way of example in conjunction with FIGS. 2 and 16.

An audio stream 202 (i.e., the multichannel audio signal), is received S1602 by the device 200 at a receiving stage (not shown) of the device. The device 200 further comprises an object extraction stage 204 arranged for extracting S1604 at least one audio object 206 from the time frame of the multichannel audio signal. As described above, the number of extracted objects at this stage may be user defined, or predefined, and may be any number between one and an arbitrary number (n). In an example embodiment, three audio objects are extracted at this stage. However, for ease of explanation, in the below description, only one audio object is extracted at this stage.

When extracting the audio object 206, panning parameters 208 (e.g., a set 208 of energy levels, each energy level corresponding to a specific channel of the plurality of channels of the multichannel audio signal 202 and relating to (e.g., indicating) an energy level of audio content of the audio object 206 that was extracted from the specific channel) are also computed. Since each channel in the multichannel audio signal has a predetermined position in space, panning parameters can be computed from the set of energy levels. Both the audio object and the panning parameters are sent to spatial position estimating stage 203 arranged for estimating S1606 a spatial position of the audio object. This estimation S16060 is thus done using the panning parameters and a spatial position (x, y) 207 is outputted from the spatial position estimating stage 203 along with the audio object 206 and the panning parameters 208.

From the spatial position 207, a risk estimating stage 210 is arranged for estimating S1608 a risk that a rendered version of the audio object 206 in channels in the first configuration will be rendered in channels with predetermined positions differing from the predetermined positions of the specific subset of the plurality of channels from which the object was extracted. The risk estimation stage 210 is arranged to detect when artistic intention is at stake, i.e. by determining S1610 whether the risk exceeds a threshold. The algorithms used in the risk estimation stage 210 will be further described below in conjunction with FIGS. 3*a*, 3*b* and 4.

In case it is determined S1610 by the risk estimation stage 210 that the risk does not exceed the threshold, the audio object 206 and metadata (e.g., the audio object 2016 and the spatial position 207) are included in the output audio content (e.g., the output audio object content). For example, the audio object 206 and the spatial position 207 are sent to a converting stage 216 which is arranged for including the audio object 206 and metadata comprising the spatial position 207 of the audio object in the output audio object content 222 which is part of the output audio content 218. It should be noted that in the context of this description, an output audio object=audio signal+metadata and output bed channel 224=audio signal+channel label.

Any metadata (e.g., metadata comprising the spatial position 207 of the audio object) may be added to the output audio object content, for example in any of the following forms:

a separate file e.g. a text file with the same name of the audio object file part of the same bitstream embedded into a "container" which is a file format including both audio and metadata (and even the output bed channel content).

It should also be noted that any audio content of the multichannel audio signal which is not extracted as audio objects, using the methods and devices described herein, will be added to the output bed channels 224. This feature is however omitted in the figures and not described further herein.

In case it is determined S1610 by the risk estimation stage 210 that the risk exceeds the threshold, the panning parameters 208 and the audio object 206 (or a fraction of the audio object 206 as will described below) are sent to an artistic preservation stage 212. The functionality and algorithms of the artistic preservation stage 212 is described below in conjunction with FIGS. 5 and 6.

Figure 3B:
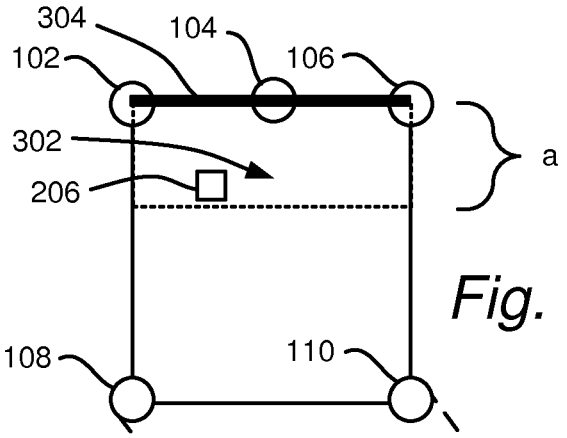
FIGS. 3*a-b* show by way of example an embodiment of the risk estimation stage of the device of FIG. 2.
Figure 3C:
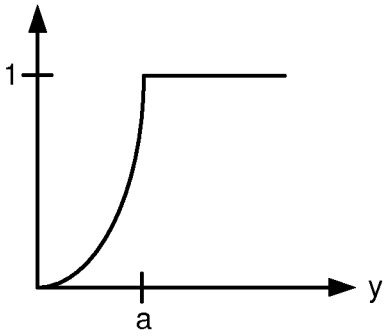
FIG. 3*c* shows a function used by the risk estimation stage of FIG. 3, for determining a fraction of an extracted object to include in the output audio object content.
Figure 3A:
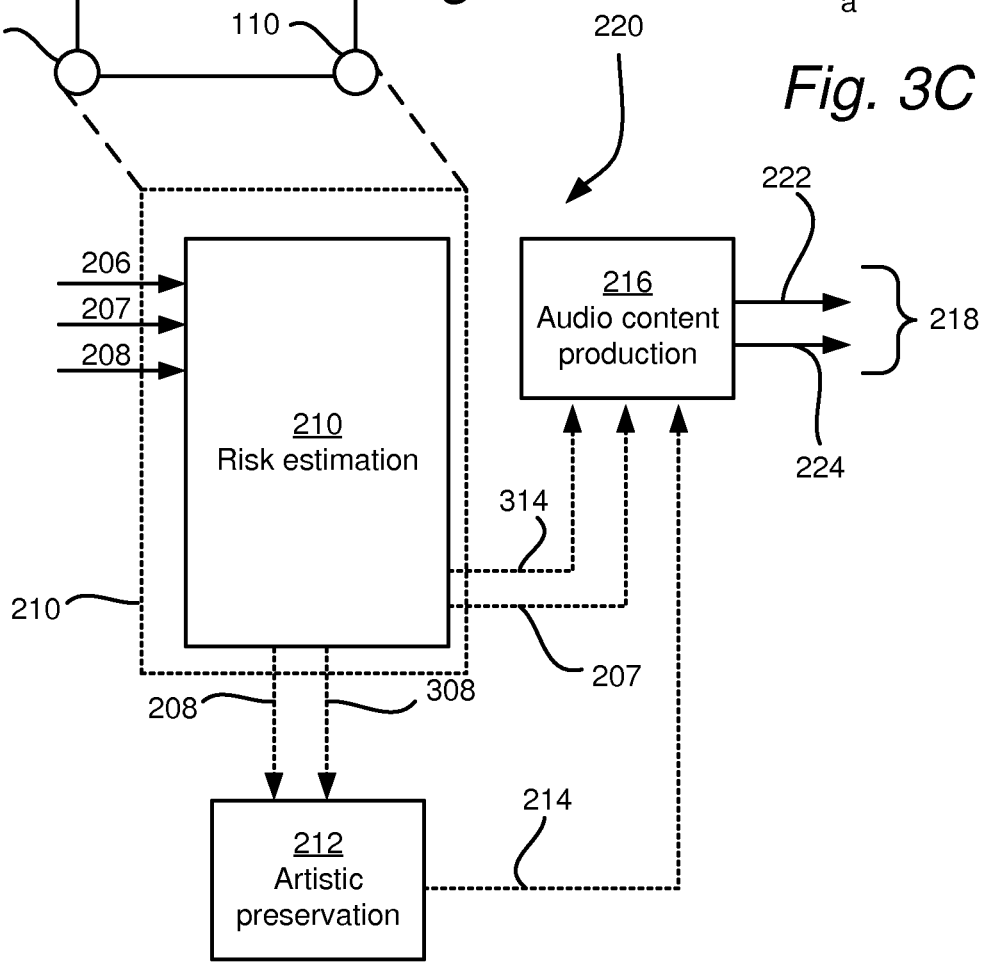

A first example embodiment of a risk estimation stage 210 is shown in FIG. 3*a*. This embodiment is based on computing the position of an extracted object, and determining how much of it should be extracted, and how much should be preserved.

In FIG. 3*a*, a smaller FIG. 3*b* is interspersed showing, by way of example, an extracted audio object 206 on a 5.1 layout (coordinates according to FIG. 17). In the layout of FIG. 3*b*, a predetermined area 302 is shown. In case the spatial position of the audio object 206 is estimated to be outside this predetermined area 302, the risk is determined to not exceed the threshold and consequently, the audio object 206 and metadata comprising the spatial position 208 of the audio object is included as is in the output audio object content 222 which is part of the output audio content 218.

The predetermined area 302 may according to embodiments include the predetermined positions of at least some of the plurality of channels in the first configuration. In this example, the first configuration corresponds to a 5.1-channel set-up and the predetermined area 302 included the predetermined positions of the L, C and R channels in the first configuration. A 7.1 layout is equally possible. As seen in FIG. 3*b* in conjunction with FIG. 17, the predetermined positions of the C, R and C channels share a common y-coordinate value (e.g., 0) in the predefined coordinate system. In this case, the predetermined area includes positions having a y-coordinate value up to a threshold distance a away from said common y-coordinate. Again, in case the spatial position is determined to be outside the predetermined area 302, i.e. further away from the common y-coordinate (i.e., 0 in this example), the risk is determined to not exceed the threshold.

According to some embodiments, the predetermined area comprises a first sub area 304. This sub area 304 may be equal to the common y-coordinate, i.e. a plane in 3D space with coordinates $0<=x<=1$, $y=0$ and $0<=z<=1$, but other sub areas are equally possible. For example, the range of the y-coordinate may be 0<=y<=0.05. In this embodiment, a fraction value is determined by the risk estimation stage 210. The fraction value corresponds to a fraction of the audio object to be included in the output audio content and is based on a distance between the spatial position 206 and the first sub area 304, wherein the value is a number between zero and one. An example function for computing the fraction value is shown in FIG. 3*c*. If the object is at y=0, the object is not extracted at all. If sufficiently far from the screen (e.g., y>a=0.15), full extraction is performed. In between, a smooth function as in FIG. 3*c* determines the fraction to extract.

The function could be e.g. $f(y)=\min(y^2/a^2, 1)$, with a=0.15. Other suitable functions and values of a are equally possible.

The extracted audio object 206 is multiplied by the fraction to extract. This way, objects in the first sub area (e.g., in the screen) will be muted, audio objects far from the first sub area will be unchanged, and audio objects 206 in the transition zone (in the predetermined area 302 but not in the first sub area 304) will be attenuated according to the value of the function. The fraction of the audio object (or the full audio object) 314 and metadata comprising the spatial position 207 of the audio object 206 are sent to the converting stage 216 which is arranged for including the fraction of the audio object (or the full audio object) 314 and metadata comprising the spatial position 207 of the audio object in the output audio object content 222 which is part of the output audio content 218.

An advantage of the above embodiments explained in conjunction with FIGS. 3*a-c* is that they require a low computational cost, and are easy to implement.

It should be noted that the same procedure can be applied to other zones (other than the zone near the screen as in this example) of the room in a similar way.

In parallel, the extracted audio object is multiplied by 1 minus the fraction value (e.g., 1−f(y)) and the resulting fraction of the audio object 308 is sent to the artistic preservation stage 212 which is exemplified below in conjunction with FIGS. 5-6.

Figure 4:
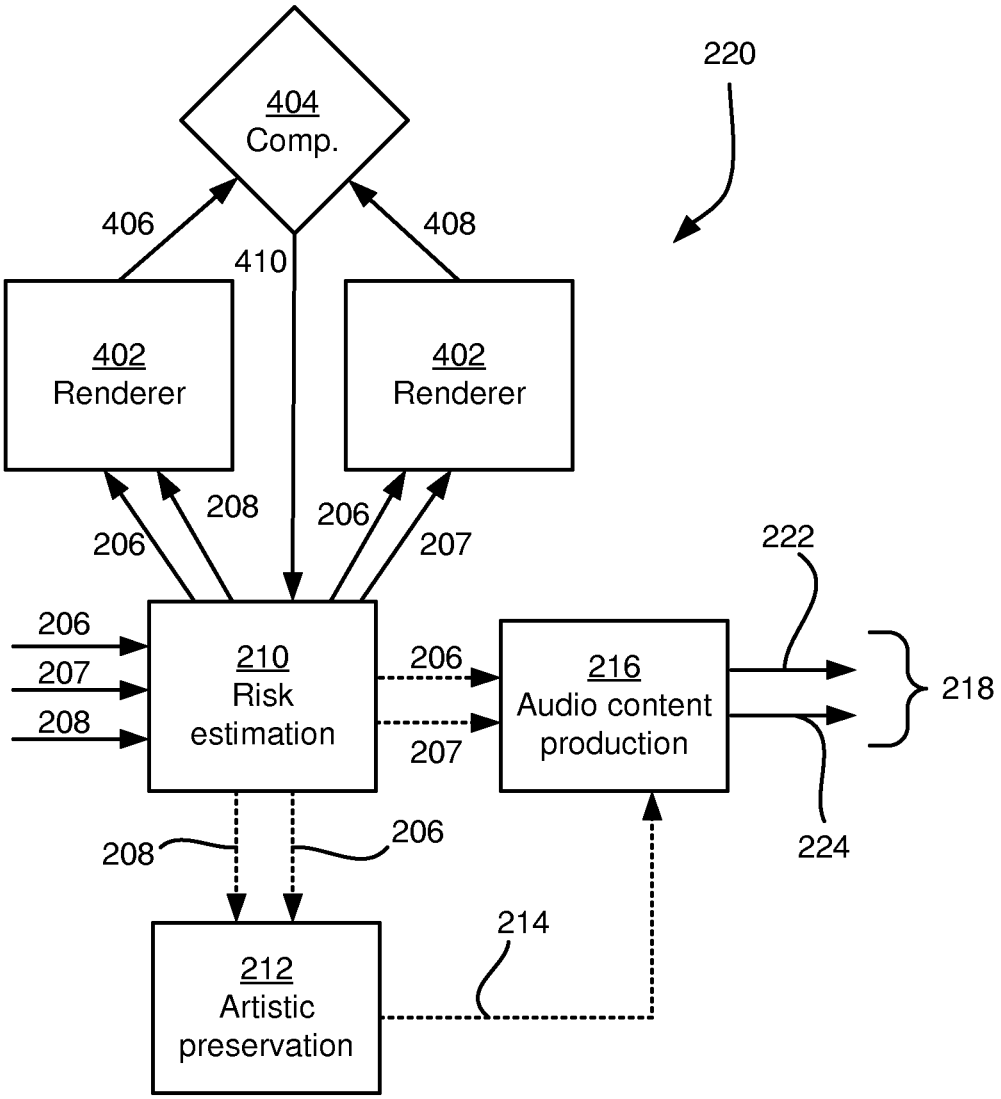
FIG. 4 shows by way of example an embodiment of the risk estimation stage of the device of FIG. 2

Another embodiment of the risk estimation stage 210 is shown in FIG. 4. This embodiment is based on comparing the extracted object in its original configuration (e.g., 5.1/7.1 layout) with a rendered version in the same configuration (e.g., 5.1/7.1), according to the below.

For this embodiment, the panning parameters 208 are needed. For this reason the extracting of an audio object (see FIG. 2, the object extraction stage or source separation stage 204) from the multichannel audio signal comprises computing a first set of energy levels, where each energy level corresponds to a specific channel of the plurality of channels of the multichannel audio signal and relates to (e.g., indicating) an energy level of audio content of the audio object that was extracted from the specific channel. The panning parameters 208 are thus received by the risk estimation stage 210 along with the extracted audio object 206 and the estimated spatial position 207.

For estimating the risk of faulty rendering of the audio object, the spatial position of the audio object is used for rendering the audio object to a second plurality of channels in the first configuration and computing a second set of energy levels based on the rendered object, each energy level corresponding to a specific channel of the second plurality of channels in the first configuration and relating to (e.g., indicating) an energy level of audio content of the audio object that was rendered to the specific channel of the second plurality of channels. The two sets of energy levels are then compared and a difference is calculated, for example using the absolute difference of each corresponding energy levels (e.g., of each pair of corresponding energy levels). Based on this difference, the risk is estimated.

FIG. 4 shows a further embodiment based on comparing the extracted object in its original configuration (e.g., 5.1/7.1 layout) with a rendered version in the same configuration (e.g., 5.1/7.1). In this embodiment, the step of calculating a difference between the first set of energy levels and the second set of energy levels comprises using the first set of energy levels 208, rendering the audio object using a renderer 402 to a third plurality of channels 406 in the first configuration. Further, using the spatial position 207 of the audio object 206, this embodiment comprises rendering the audio object 206 using a renderer 402 to a second plurality of channels 408 in the first configuration. For each pair of corresponding channels of the third and second plurality of channels, measuring a Root-Mean-Square, RMS, value (i.e., an energy level) of each of the pair of channels, determining an absolute difference in a comparison stage 404 of the device 200, between the two RMS values, and calculate a sum 410 of the absolute differences for all pairs of corresponding channels of the third and second plurality of channels. The sum 410 is then sent to the risk estimation stage 210 again, where it is used for determining whether the risk exceeds a threshold by comparing the sum to the threshold.

In case the risk is determined to fall below the threshold, the audio object 206 and metadata (e.g., comprising the spatial position 207 of the audio object 206) are included into the output audio content (e.g., output audio object content). For example, the audio object 206 and metadata (e.g., comprising the spatial position 207 of the audio object) are sent to the converting stage 216 as described above. In case the risk exceeds the threshold, the audio object 206 and the set of energy levels 208 is sent to the artistic preservation stage 212. Embodiments of such stage 212 will now be described in conjunction with FIGS. 5-6.

According to some embodiments, if the extracted object is detected as violating an artistic intention (exceeding the threshold), its content in the original multichannel format (e.g., 5.1/7.1) is kept as a residual signal and added to the output bed channels. This embodiment is shown in FIG. 5. In order to render the audio object 206 in the output bed channels 224, the panning parameters, or the set of energy levels computed when extracting the audio object from the multichannel audio signal, are needed. For this reason, the panning parameters 208 and the audio object is both sent to the artistic preservation stage 212. In the artistic preservation stage 212, the panning parameters 208 are applied to the extracted object 206 to obtain the multichannel version 502 of the object to preserve. The multi channel version 502 is then added to the output bed channels 224 in the converting stage 216.

It should be noted that the above embodiment also can be applied to the embodiment of FIGS. 3*a-c*. Accordingly, according to embodiments, a second fraction of the audio object is received by the artistic preservation stage 212 along with the panning parameters 208 of the audio object. The second fraction is achieved by multiplying the audio object with 1 minus the fraction value f(y) (FIG. 3*c*) and using the first set of energy levels 208 for rendering the second fraction of the audio object to the bed channels via a multichannel version 502 of the second fraction of the object, as described above.

Figure 6:
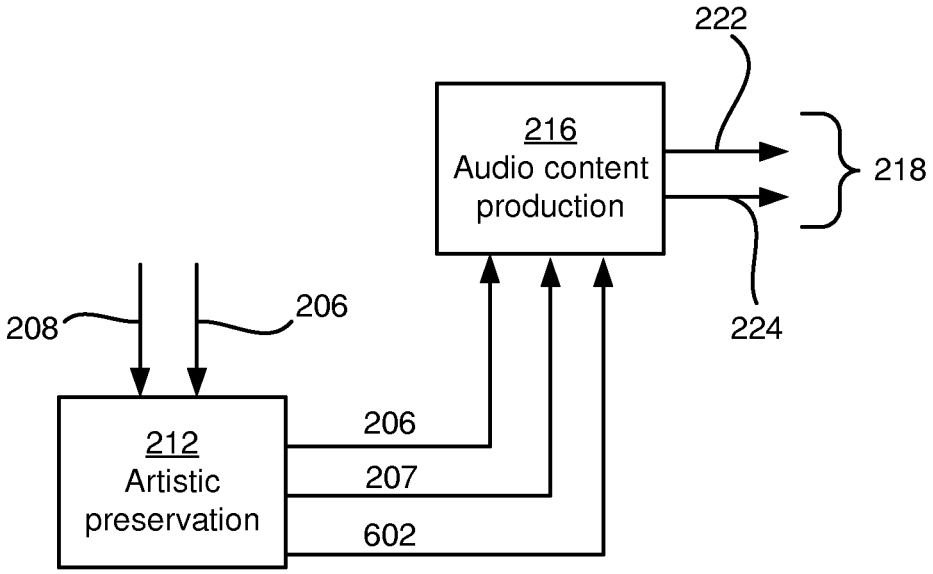
FIG. 6 shows by way of example, an embodiment of an artistic preservation stage of the device of any of one of FIGS. 2-4, FIGS. 7-10 show a method for spreading objects positioned on screen to map them to an arch encompassing the screen, according to embodiments of the disclosure.
Figure 7:
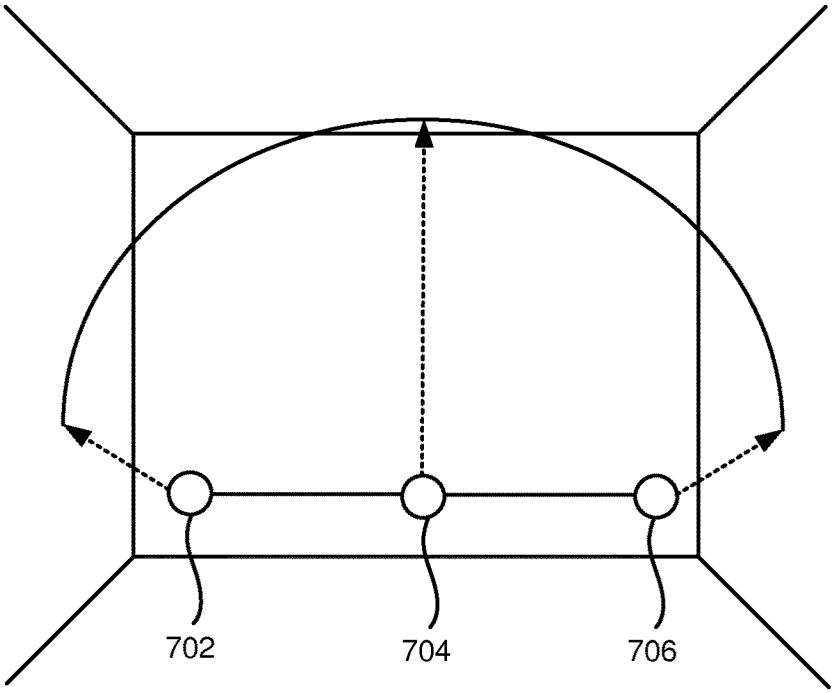
Figure 8:
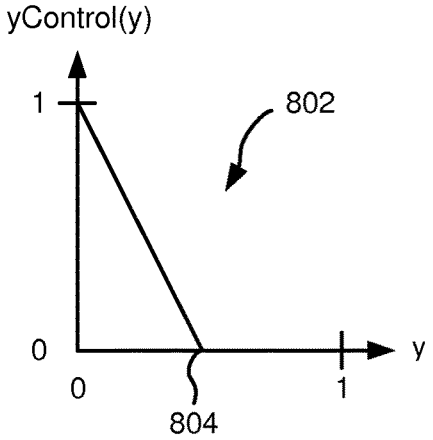
Figure 9:
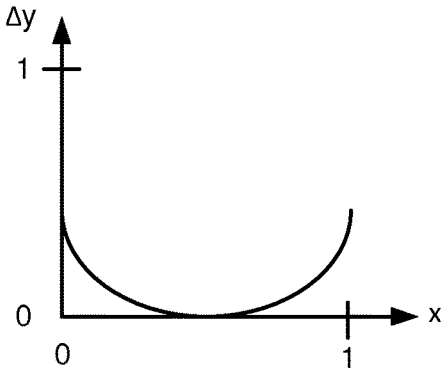
Figure 10:
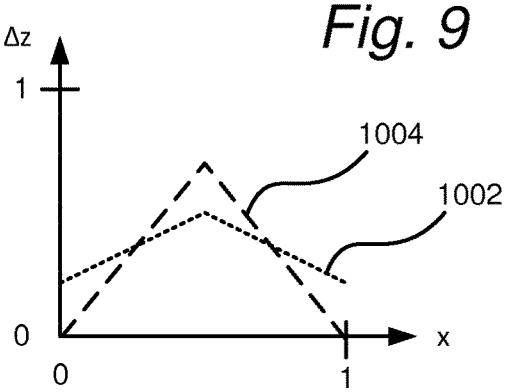

FIG. 6 shows another example of the artistic preservations stage 212. This embodiment is based on computing additional metadata to accompany object extraction in cases where artistic intention may be violated by normal object extraction. If the extracted object is detected as violating an artistic intention (as described above), it can be stored as a special audio object along with additional metadata (e.g., its panning parameters that describe how it was panned in the original 5.1/7.1 layout) and included in the output audio object content 222 which is part of the output audio content 218.

This method also applies to the partially preserved object (second fraction) resulting from the embodiment of FIG. 3*a-c*.

The additional metadata is computed using the panning parameters 208 and can be used to preserve the original artistic intention, e.g. by one of the following methods at the rendering stage:

1) Render the object to channels using the original panning parameters

2) Apply specific panning rules (e.g., divergence, zone masks, etc.) in order to render it as an object while preserving the original artistic intention. That is, the additional metadata can be used at the rendering stage to ensure that the audio object is rendered in channels in the first configuration with predetermined positions corresponding to the predetermined positions of the specific subset of the plurality of channels from which the object was extracted.

In other words, in this embodiment, the artistic preservation stage 212 is computing an additional metadata 602 which is sent to the converting stage 216 and added to the output audio content 218 along with the audio object and the metadata comprising the spatial position 207 of the audio object 206. The additional metadata 602 indicates at least one from the list of:

- the specific subset of the plurality of channels from which the object was extracted,
- at least one channel of the plurality of channels which is not included in the specific subset of the plurality of channels from which the object was extracted (e.g., a zone mask), and
- a divergence parameter.

For example, the additional metadata 602 may indicate the panning parameters (set of energy levels) 208 computed when extracting the audio object 206.

Figure 5:
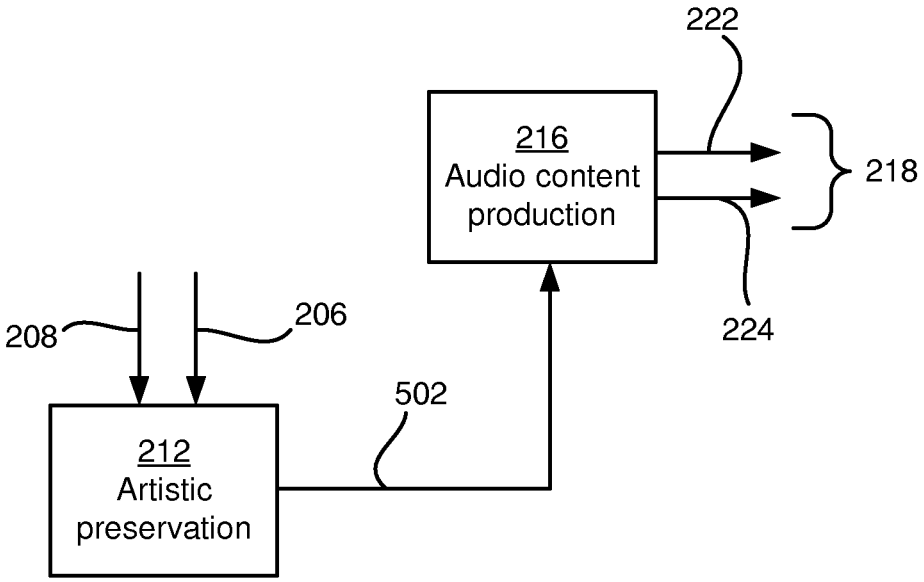
FIG. 5 shows by way of example an embodiment of an artistic preservation stage of the device of any of one of FIGS. 2-4.

If the extracted object were detected as violating an artistic intention, using either the embodiments of FIG. 5 or 6 to preserve the artistic intention would neutralise the object extraction itself. For example, the extracted object might be left without signal by applying the embodiment of FIGS. 3*a-c* if the fraction to be extracted is zero. In such cases, and also in other cases, it may be desirable to perform object extraction again, in order to extract the next significant components. In order to do so, the following strategy may be used:

1) Once an object is detected as potentially violating artistic intention, obtain its multichannel version by applying the panning parameters (set of energy levels) computed when extracting the audio object. In other words, use the first set of energy levels for rendering the audio object to a second plurality of channels in the first configuration 2) subtract audio components of the second plurality of channels from audio components of the first plurality of channels, and obtaining a time frame of a third multichannel audio signal (i.e., a difference signal).

3) Then, run again object extraction on the difference signal. In other words, extract at least one further audio object from the time frame of the third multichannel audio signal, wherein the further audio object being extracted from a specific subset of the plurality of channels of the third multichannel audio signal.

4) Apply any embodiment described above to detect violation of artistic intention of each of the extracted further audio objects, in which case any of the embodiments for artistic preservations described above is applied, and re-iterate from step 1) until a certain stop criterion is met.

The stop criterion may be at least one stop criterion from the following list of stop criteria:

- an energy level of an extracted further object is less than a first threshold energy level,
- a total number of extracted objects exceed a threshold number, e.g. 1, 3 or 6 or any other number, and
- an energy level of the obtained time frame of the difference multichannel audio signal is less than a second threshold energy level.

The disclosure will now turn to methods, devices and computer program products for modifying e.g. the output of LTA (processing a time frame of an audio object) in order to enable artistic control over the final mix.

All methods relate to processing a time frame of audio content having a spatial position. In the following, the audio content is exemplified as an audio object, but it should be noted that the methods described below also applies to audio channels, based on their canonical positions. Also, for simplicity of description, sometimes the time frame of an audio object is referred to as "the audio object".

As described above, Legacy-to-Atmos (LTA) is a content creation tool that takes 5.1 or 7.1 content (which could be a full mix, or parts of it, e.g., stems) and turns it into Atmos content, consisting of objects (audio+metadata) and bed channels. Such process is typically blind, based on a small set of predefined parameters that provide a very small degree of aesthetical control over the result. It is thus desirable to enable a processing chain that modifies the output of LTA in order to enable artistic control over the final mix. The direct manipulation of each individual object extracted by LTA is, in many cases, not viable (objects too unstable and/or with too much leakage from others, or simply too time-consuming). Below, a set of high-level controls for the mixer will be described in conjunction with FIGS. 7-15 and 18. These algorithms are controlled by intuitive, high-level parameters that can vary over time and can either be controlled manually or pre-set, or inferred automatically based on the characteristics of the content. These methods may be referred as post-processing, because they take Atmos content (i.e., audio objects and bed channels) as input (as opposite to LTA, which takes 5.1/7.1 as input). For example, a use case may be when that content is the output of LTA.

In the following, several methods for providing artistic control over object-based audio content are described, which methods can be divided into three sub-classes of methods:

- Screen Spread: spreading of objects in a specific region (e.g., near the screen). According to some embodiments, the screen spread effect is only applied to music content, and not to dialogue content.
- Height boost: increasing the level of subtle elements positioned away from critical regions (e.g., objects away from the screen and the horizontal plane).
- Ceiling attraction: repositioning of elements, e.g. increasing their height as a function of their distance from the screen.

Each of these methods, used separately or in conjunction with one or more of the others, provides additional artistic control over an object-based audio content.

Figure 18:
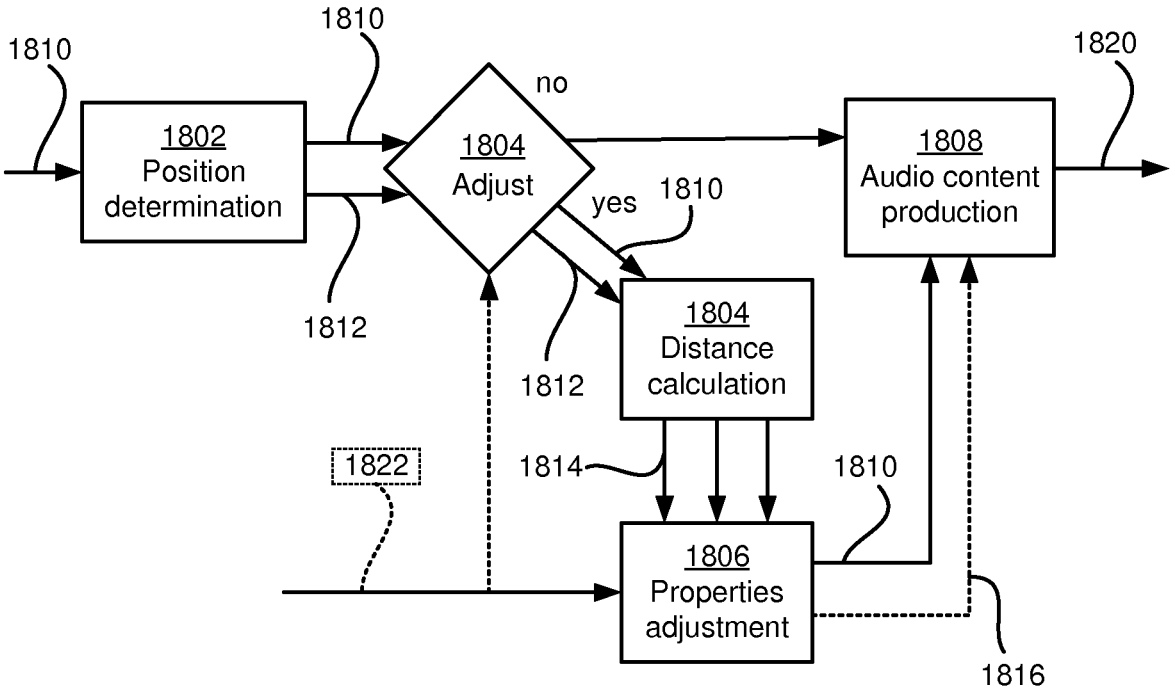

Each of the methods share common features which now will be explained in conjunction with FIG. 18 and then exemplified in conjunction with FIGS. 7-15.

Each method is for processing a time frame of an audio object. A device 1800 implementing the method is shown in FIG. 18. The device comprises a processor arranged to receiving the time frame of the audio object 1810, and to determine a spatial position of the time frame of the audio object 1810 in a position estimation stage 1802. Such determination may for example be done using a received metadata comprising the spatial position of the audio object and received in conjunction with receiving the time frame of the audio object 1810. The time frame of the audio object 1810 and the spatial position 1812 of the audio object is then sent to an adjustment determination stage 1804.

Based on at least the spatial position 1812 of the audio object, the processor determines whether properties of the audio object should be adjusted. According to some embodiments, such determination can also be made based on a control value 1822 received by the adjustment determination stage 1804. For example, if the control value 1822 is 0 (i.e., no adjustment to be made), the value can be used to exit the adjustment determination stage 1804 and send the time frame of the audio object 1810 as is to an audio content production stage 1808. In other words, in case it is determined that properties should not be adjusted, the time frame of the audio object 1810 is sent as is to an audio content production stage 1808 to be included in the output audio content 1820. However, upon determining that properties of the audio object should be adjusted, the time frame of the audio object 1810 and the spatial position 1812 of the audio object are sent to a distance calculation stage 1804 which is arranged to determine a distance value 1814 by comparing the spatial position 1812 of the audio object to a predetermined area. As described above, in this disclosure, the methods, devices and computer-program products are exemplified in a 3D coordinate system having an x component, a y component and a z component, where a possible range for the x component, the y component and the z component which is $0<=x<=1$, $0<=y<=1$, $0<=z<=1$. In this coordinate system, the predetermined area corresponds to coordinates in the range of $0<=x<=1$, $y=0$ and $0<=z<=1$ (e.g., the screen area in a room). The distance value is determined using the y component of the spatial position as the distance value.

The distance value 1814, the spatial position 1812 and the time frame of the audio object 1810 is sent to a properties adjustment stage 1806, which also receives a control value 1822. Based on at least the distance value 1806 and the control value 1822 at least one of the spatial position and an energy level of the audio object is adjusted. In case the spatial position is adjusted, the adjusted spatial position 1816 is sent to the audio content production stage 1808 to be included in the output audio content 1820 along with the (optionally adjusted) time frame the audio object 1810.

FIG. 7-10 describe a method for spreading sound to the proscenium speakers (Lw, Rw), and optionally even using the first line of ceiling speakers to create an arch around the screen. According to this method, the properties of the audio object are determined to be adjusted if the distance value does not exceed a threshold value, i.e. the spatial position is close to the screen. This can be controlled using the function 802 (yControl(y)) shown in FIG. 8, which has a value of 1 near the screen and decays to zero away from the screen, where reference 804 represent the threshold value as described above. To achieve the spreading effect, the spatial position is adjusted at least based on the distance value and on the x-value of the spatial position. For example, the z value of the spatial position of the object may be adjusted based on the x-value of the spatial position, e.g. as described in FIG. 10 where two transfer functions 1002, 1004 between the x-value of the spatial position and their respective effect on the z-value of the spatial position of the audio object are shown. Alternatively or additionally, the y value of the spatial position may be adjusted based on the x value of the spatial position as described in FIG. 9.

According to some embodiments the method described in FIG. 7-10 includes:

1) Build a function yControl(y) that has a value of 1 near the screen and decays to zero away from the screen (e.g., FIG. 8).
2) Move the objects at the side of the screen towards $y>0$, by increasing their y coordinate by $\Delta y(x)$ as function of their x coordinate (e.g., FIG. 9)
3) Multiply the amount of spread $\Delta y(x)$ by yControl: this ensures that the spread is only applied to objects near the screen. $y_out=y_in+\Delta y(x_in)*yControl(y_in)$.
4) Raise the height of objects near the centre of the screen by increasing their z coordinate as a function of x (FIG. 10): $z_out=\min(1, z_in+\Delta z(x_in))$.
5) compute the final object position blending the original and the modified one as a function of an external control "Spread amount". Pos_out=spread_amount*(x_in, y_out, z_out)+(1-spread_amount)*(x_in, y_in, z_in).

It should be noted that bed channels do not have associated position metadata; in order to apply the processing to L, C, R channels, in the current implementation they may be turned into static objects located at their canonical positions. As such, also the spatial position of bed channels can be modified according to this embodiment.

Figure 11:
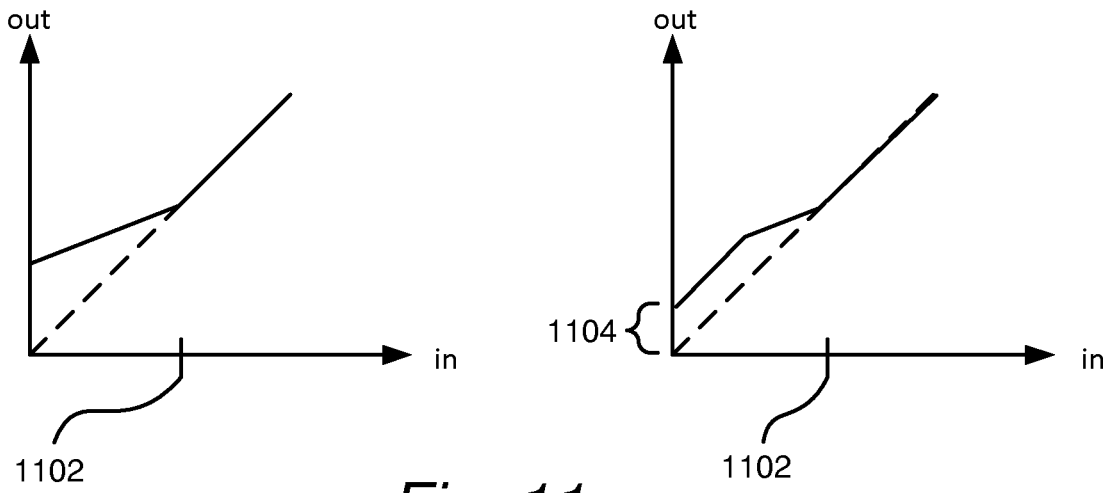
FIGS. 11-13 show a method for boosting subtle audio objects and bed channels which are positioned out of screen.
Figure 12:
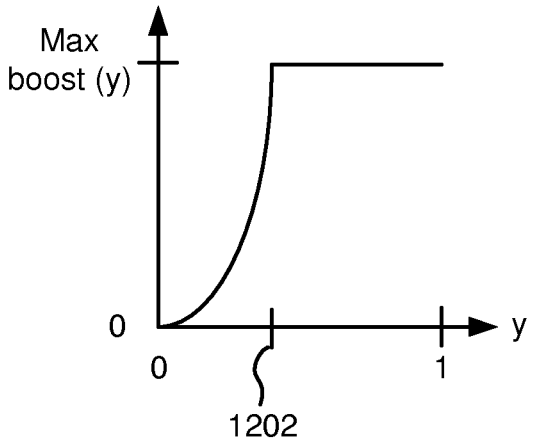
Figure 13:
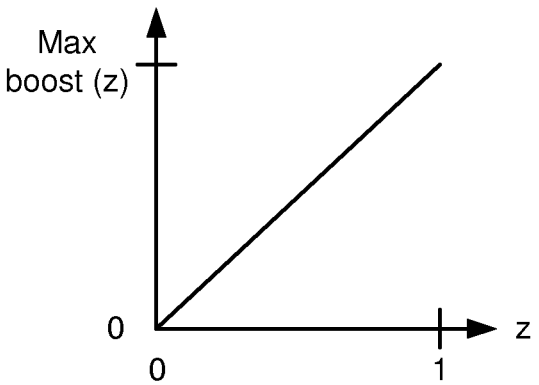

FIGS. 11-13 show a method for processing a time frame of an audio object according to another embodiment. Sometimes, the effect of LTA vs. the original 5.1/7.1 multichannel audio signal (legacy signal) is subtle. This is due to the fact that the perception of sound in 3D seems to call for enhanced immersion, i.e. boost of subtle out-of-screen and ceiling sounds. For this reason, it may be advantageous to have a method to boost subtle (soft) audio objects and bed channels when they are out of the screen. Bed channels may be turned into static objects as described above. According to some embodiments, the boost may increases proportionally to the z coordinate, so objects on the ceiling and Lc/Rc bed channels are boosted more, while objects on the horizontal plane are not boosted. Accordingly, the properties of the audio object are determined to be adjusted only if the distance value exceeds a threshold value, wherein upon determining that properties of the audio object should be adjusted, the total energy level is adjusted at least based on the distance value and on the z-value of the spatial position. FIG. 12 shows a transfer function between a y-coordinate (of the time frame) of the audio object, and a max boost of the energy level (e.g., RMS). As can be seen in FIG. 12, objects positioned near $y=0$ are not boosted, which in this case corresponds to the threshold value. The threshold value could be 0 or 0.01 or 0.1 or any other suitable value. FIG. 13 shows a transfer function between a z-coordinate (of the time frame) of the audio object, and a max boost of the energy level. The energy level is thus adjusted based on the distance value and on the z-value of the spatial position.

FIG. 11 shows by way of example how boosting of low energy audio objects may be achieved. FIG. 11, left, shows boosting the low level parts. In order to avoid excessive boost on soft signals (the mixer left them soft for good reasons), the addition of a max boost limit 1104 allows us to obtain the desirable curve of FIG. 11, right. For this reason, first energy level of the time frame of the audio object needs to be determined, e.g. the RMS of the audio content of the audio object. The energy level is adjusted also based on this energy level, but only if the energy level does not exceed a threshold energy level 1102.

According to some embodiments, the boost is adapted to a boost at previous frames for this audio object, to achieve a smooth boosting of the audio object. For this reason, the method may comprise receiving an energy adjustment parameter pertaining to a previous time frame of the audio object, wherein the energy level is adjusted also based on the energy adjustment parameter.

According to some embodiments, the algorithm for adjusting the energy level of the audio object may be as follow:

For each audio object and for each time frame of the audio object:

1) Get energy level and position metadata; the level is the RMS of the object or bed-channel audio in current frame.
2) Compute max allowed boost depending on position only. The position dependent boost is dependent on Y (don't boost objects positioned in the screen) and Z (the higher the object/channel, the more boost is applied), and is the product of the two functions shown in FIGS. 12 and 13.
3) Compute the transfer function between the in energy level of the audio object and the out energy level as shown in FIG. 11, right, which depends on the max boost limit 1104 and the threshold energy level 1102 and calculate an initial boost value determined by the difference between out and in energy levels.
4) Compute the desired boost ("boost" below) by multiplying the initial boost value of 3) with the product of 2).
5) Make the boost adaptive to the boost at previous frames:
   if boost>previous_boost
      adaptive_boost=alpha_attack*boost+(1−alpha_attack)*previous_boost;
   else
      adaptive_boost=alpha_release*boost+(1−alpha_release)*previous_boost;
   where alpha_attack and alpha_release are different time constants depending on whether the level of the previous audio frame was softer or louder than the current one
6) Keep applied boost per audio object/bed in memory, updating the value of previous boost.
7) Apply adaptive_boost to the time frame of the audio object According to some embodiments, a user control "boost amount" in the range [0 1] is converted to max boost limit 1104 and the threshold energy level 1102 so that a value 0 has no effect, while a value of 1 achieves maximum effect.

It should be noted that while currently the RMS is evaluated for every single object independently, it is also foreseen the case where objects are compressed based on the overall RMS, or the RMS of objects and channels belonging to specific regions of the room.

For the above embodiments (as described in conjunction with FIGS. 11-13), at least some of the following constraints were taken into account:

Expose as few parameters as possible to the user: ideally, "one knob controls the effect" (e.g., the user control "boost amount").

Boost has to depend on loudness and position.

The "one knob that controls the effect" should act in a way such that if turned to zero we get exactly the same results as before introducing this feature.

Boost has to be applied with proper time constants to avoid overshooting during sudden loud transients and sudden "pumping-up" of sudden soft sounds.

Figure 14:
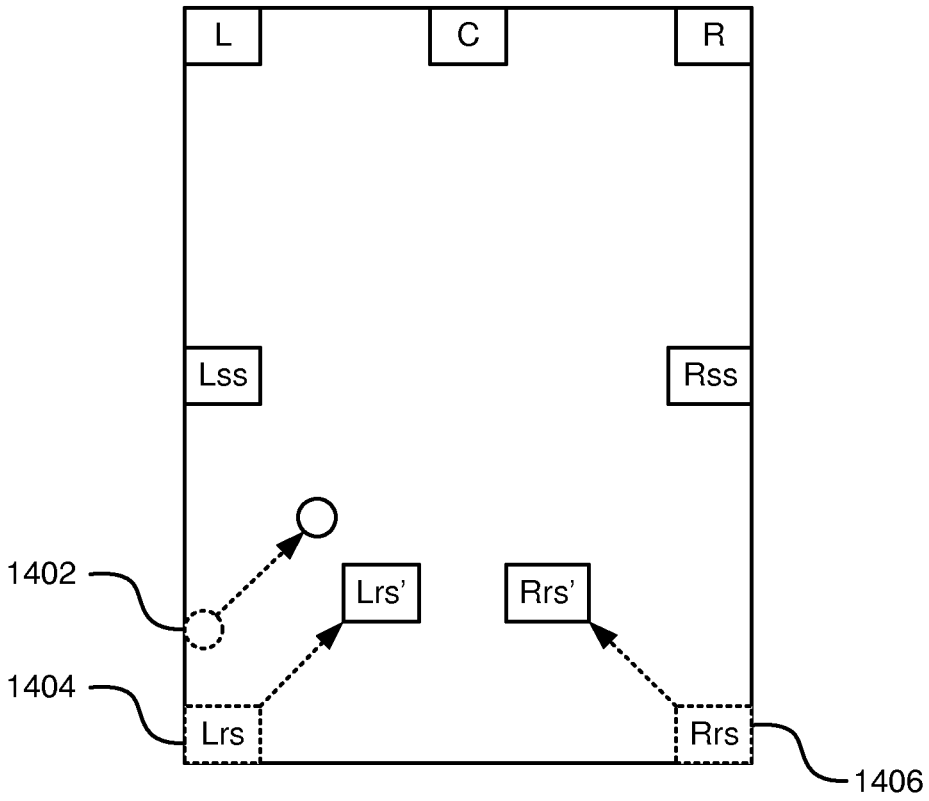
FIG. 14-15 show a method for increasing the z-coordinate of audio objects positioned in the rear part of a room.
Figure 15:
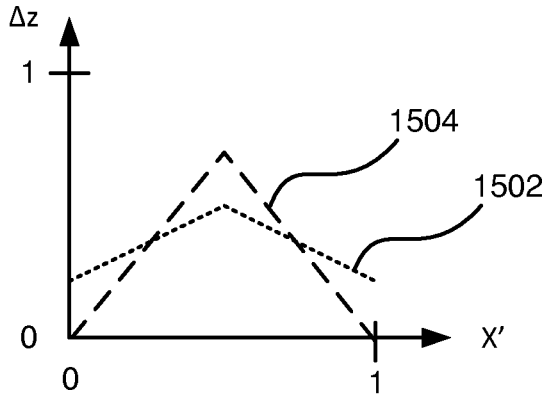

FIGS. 14-15 shows other embodiments of methods for processing a time frame of an audio object.

When applying LTA to typical cinematic or music content, the main expectation of the audience is to hear sounds coming from the ceiling. Extracted objects are located in the room according to their spatial position (x,y) inferred from the 5.1/7.1 audio, and the z coordinate may be a function of the spatial position (x,y) such that as the object moves inside the room, the z-value increases. By design of this functions, objects on the walls will stay at z=0, while objects in the centre of the room will rise to z=1. However, it turns out that most of the sources that make a typical 5.1/7.1 mix result in either static audio objects on the walls, or they are panned dynamically between pairs of channels, thus covering trajectories on the walls. Therefore, with LTA, the extracted audio objects may just stay on the walls in the horizontal plane. FIG. 14-15 describe a method for pushing objects to the ceiling when they were panned on the walls in the rear part of the room. The proposed method consists of modifying the canonical 5.1/7.1 speaker positions by pushing the surround speakers (Lrs, Rrs) inside the room, so that audio objects located on the walls will naturally gain elevation. This results in that the properties of the audio object are determined to be adjusted only if the distance value exceeds a threshold value, i.e. they are located in the rear part of the room. The z value of the spatial position may then be adjusted based on the distance value. For example, the further back in the room the spatial position is the larger will the z-value be. In other words, the z value is adjusted to first value for a first distance value, and to a second value lower than the first value for a second distance value being lower than the first distance value.

Going more into detail, in LTA, the object position (x,y) is computed from the gains of the 5.1/7.1 speakers and their canonical position, essentially by inverting the panning law. If the surround speakers are moved from their canonical position, towards the centre of the room, when inverting the panning laws, a warping of objects trajectories are achieved, essentially bending them inside the room, and therefore resulting in the z coordinate to grow. FIG. 14 illustrates the concept where the Lrs and the Rrs speakers 1404, 1406 are moved towards the center of the room, which means that also the position of the audio object 1402 is moved. How much the speakers are moved into the room may depend on the parameter "remap amount" in the range [0, 1], where a value of 0 produces no change in the usual obtained object position, while a value of 1 reaches the full effect.

The input to this algorithm is the position of the object (x, y, z) and the amount of remapping (i.e., the control value). According to some embodiments, the output is a new object position where (x, y) are preserved and z is adjusted.

The steps involved according to one embodiment are:

1) Given the spatial position (x,y) of an audio object, compute the Atmos gains to a 7.1 layout (even if the original content was 5.1). In other words, after source separation, the spatial position (x, y) of the audio object is determined. Since the spatial position now is known, the gains that the audio object would produce in 7.1 layout can now be computed, i.e. based on the spatial position. By using a 7.1 layout, the Lss/Rss positions can be fixed to their original position, rather than moving them inside, to avoid adjustment of the z-value of audio objects in the front-half of the room.

2) Given the canonical positions of 7.1, and the value of "remap amount", move Lrs 1404 and Rrs 1406 towards the center of the room.

3) Given the modified layout, and the gains computed at step 1, compute the new corresponding spatial position (x',y') of the audio object (see FIG. 14).

4) Given the adjusted spatial position (x',y'), compute an adjusted z-value (z') by applying a function z'=f(x',y') that increases elevation towards the center of the room. For example, the function may have the shape of a pyramid with a square base (the sides of the room at z=0) and the tip in the middle of the ceiling, for example as shown in FIG. 15 which includes two different transfer functions between the adjusted x-value (x") and the adjusted z value (z').

5) Output the adjusted position (x,y,z') as new object position; notice that the original x-value and y-value (x,y) is retained, although one may want to use the modified (x',y') as well if the effect of moving the objects towards the inside of the room is also desired.

As described above, the above effect can be applied to the channels (e.g., bed channels) by turning them into static objects at canonical positions.

The present disclosure also relate to a method for storing, archiving, rendering or streaming content produced with the above methods The method is based on the observation that the final Atmos content, when authored via LTA and the post-processing described above, can be re-obtained from the information contained only in:

i) the original 5.1/7.1 content, ii) all the time-varying LTA+post-processing parameters (e.g., the control value as tweaked by mixer or determined automatically based on content analysis, etc.).

Hence, there is no need to store/archive/render/stream the full Atmos content obtained by these means. Given that the original 5.1/7.1 content already exists, there is need to retain only a comparatively very small piece of data containing the time-varying parameters.

Advantages of this method are multiple. When storing/archiving in this way, space (computer memory) is saved. When streaming/broadcasting, there is just need to add a tiny amount of bandwidth over the standard 5.1/7.1 content, as long as the receivers are able to run LTA on the 5.1/7.1 content using the additional parameters. Also, in workflows for language dubbing, the 5.1/7.1 stems are always distributed anyway. So if the LTA version is supposed to be dubbed, all that worldwide studios need to share, besides what they currently do, is the small file containing the LTA parameters as described above.

Note that the set of parameters to be stored include all those described in this disclosure, as well as all others needed to fully determine the LTA process, including for example, those disclosed in the above disclosure aimed at preserving artistic decisions made during creation of the original 5.1/7.1.

IV. Equivalents, Extensions, Alternatives and Miscellaneous

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units or stages referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

Various aspects of the present invention may be appreciated from the following enumerated example embodiments (EEEs):

EEE 1. A method for converting a time frame of a multichannel audio signal into output audio content comprising audio objects, metadata comprising a spatial position for each audio object, and bed channels, wherein the multichannel audio signal comprises a plurality of channels in a first configuration, each channel in the first configuration having a predetermined position pertaining to a loudspeaker setup and defined in a predetermined coordinate system, the method comprising the steps of:

a) receiving the multichannel audio signal, b) extracting at least one audio object from the time frame of the multichannel audio signal, wherein the audio object being extracted from a specific subset of the plurality of channels, and for each audio object of the at least one audio object:

c) estimating a spatial position of the audio object, d) based on the spatial position of the audio object, estimating a risk that a rendered version of the audio object in channels in the first configuration will be rendered in channels with predetermined positions differing from the predetermined positions of the specific subset of the plurality of channels from which the object was extracted, e) determining whether the risk exceeds a threshold, f) upon determining that the risk does not exceed the threshold, include the audio object and metadata comprising the spatial position of the audio object in the output audio object content.

EEE 2. The method of EEE 1, wherein the step of estimating a risk comprises the step of:

comparing the spatial position of the audio object to a predetermined area, wherein the risk is determined to exceed the threshold if the spatial position is within the predetermined area.

EEE 3. The method of EEE 2, wherein the predetermined area includes the predetermined positions of at least some of the plurality of channels in the first configuration.

EEE 4. The method of EEE 3, wherein the first configuration corresponds to a 5.1-channel set-up or a 7.1-channel set-up, wherein the predetermined area includes the predetermined positions of a front left channel, a front right channel, and a center channel in the first configuration.

EEE 5. The method of EEE 4, wherein the predetermined positions of the front left, front right and center channels share a common y-coordinate value in the predefined coordinate system, wherein the predetermined area includes positions having a y-coordinate value up to a threshold distance away from said common y-coordinate value.

EEE 6. The method of any one of EEEs 2-5, wherein the predetermined area comprises a first sub area, the method further comprises the step of:

determining a fraction value corresponding to a fraction of the audio object to be included in the output audio object content based on a distance between the spatial position and the first sub area, wherein the value is a number between zero and one, wherein if the fraction value is determined to be more than zero, the method further comprises:

multiplying the audio object with the fraction value to achieve a fraction of the audio object, and including the fraction of the audio object and metadata comprising the spatial position of the audio object in the output audio object content.

EEE 7. The method of EEE 1, wherein the step of extracting at least one audio object from the multichannel audio signal comprises, for each extracted audio object, computing a first set of energy levels, each energy level corresponding to a specific channel of the plurality of channels of the multichannel audio signal and relating to an energy level of audio content of the audio object that was extracted from the specific channel, wherein the step of estimating a risk comprises the steps of:

using the spatial position of the audio object, rendering the audio object to a second plurality of channels in the first configuration and computing a second set of energy levels based on the rendered object, each energy level corresponding to a specific channel of the second plurality of channels in the first configuration and relating to an energy level of audio content of the audio object that was rendered to the specific channel of the second plurality of channels, calculating a difference between the first set of energy levels and the second set of energy levels, and estimating the risk based on the difference.

EEE 8. The method of EEE 7, wherein the step of calculating a difference between the first set of energy levels and the second set of energy levels comprises:

using the first set of energy levels, rendering the audio object to a third plurality of channels in the first configuration, for each pair of corresponding channels of the third and second plurality of channels, measuring a Root-Mean-Square, RMS, value of each of the pair of channels, determining an absolute difference between the two RMS values, and calculate a sum of the absolute differences for all pairs of corresponding channels of the third and second plurality of channels, wherein the step of determining whether the risk exceeds a threshold comprises comparing the sum to the threshold.

EEE 9. The method of any one of EEEs 1-8, wherein the step of extracting at least one audio object from the multichannel audio signal comprises, for each extracted audio object, computing a first set of energy levels, each energy level corresponding to a specific channel of the plurality of channels of the multichannel audio signal and relating to an energy level of audio content of the audio object that was extracted from the specific channel, the method further comprising the step of:

upon determining that the risk exceed the threshold, using the first set of energy levels for rendering the audio object to the output bed channels.

EEE 10. The method of EEE 9 when dependent on EEE 6, further comprising the steps of:

multiplying the audio object with 1 minus the fraction value to achieve a second fraction of the audio object, and using the first set of energy levels for rendering the second fraction of the audio object to the output bed channels.

EEE 11. The method of any one of EEEs 1-8, further comprising the step of:

including in the output audio object content: the audio object, metadata comprising the spatial position of the audio object and additional metadata, wherein the additional metadata indicates at least one from the list of:

the specific subset of the plurality of channels from which the object was extracted, at least one channel of the plurality of channels which is not included in the specific subset of the plurality of channels from which the object was extracted, and a divergence parameter.

EEE 12. The method of EEE 11, wherein the step of extracting at least one audio object from the multichannel audio signal comprises, for each extracted audio object, computing a first set of energy levels, each energy level corresponding to a specific channel of the plurality of channels of the multichannel audio signal and relating to an energy level of audio content of the audio object that was extracted from the specific channel, wherein the additional metadata comprises the first set of energy levels.

EEE 13. The method according to any one of EEEs 1-12, wherein the step of extracting at least one audio object from the multichannel audio signal comprises, for each extracted audio object, computing the first set of energy levels, each energy level corresponding to a specific channel of the plurality of channels of the multichannel audio signal and relating to an energy level of audio content of the audio object that was extracted from the specific channel, wherein the method further comprises the steps of:

upon determining that the risk exceeds the threshold, using the first set of energy levels for rendering the audio object to a second plurality of channels in the first configuration, subtracting audio components of the second plurality of channels from audio components of the first plurality of channels, and obtaining a time frame of a third multichannel audio signal in the first configuration, extracting at least one further audio object from the time frame of the third multichannel audio signal, wherein the further audio object being extracted from a specific subset of the plurality of channels of the third multichannel audio signal, performing step c)-f) on each further audio object of the at least one further audio object.

EEE 14. The method of EEE 13, wherein the method of any one of EEEs 2-12 is performed on each further audio object of the at least one of further audio object.

EEE 15. The method of any one of EEEs 13-14, wherein yet further at least one audio objects are extracted as described in EEE 13, until at least one stop criteria of the following list of stop criterion is met:

an energy level of an extracted further audio object is less than a first threshold energy level, a total number of extracted audio objects exceed a threshold number, and a energy level of the obtained time frame of the difference multichannel audio signal is less than a second threshold energy level.

EEE 16. A computer program product comprising a computer-readable storage medium with instructions adapted to carry out the method of any one of EEEs 1-15 when executed by a device having processing capability.

EEE 17. A device for converting a time frame of a multichannel audio signal into output audio content comprising audio objects, metadata comprising a spatial position for each audio object, and bed channels, wherein the multichannel audio signal comprises a plurality of channels in a first configuration, each channel in the first configuration having a predetermined position pertaining to a loudspeaker setup and defined in a predetermined coordinate system, the device comprises:

a receiving stage arranged for receiving the multichannel audio signal, an object extraction stage arranged for extracting an audio object from the time frame of the multichannel audio signal, wherein the audio object being extracted from a specific subset of the plurality of channels, a spatial position estimating stage arranged for estimating a spatial position of the audio object, a risk estimating stage arranged for, based on the spatial position of the audio object, estimating a risk that a rendered version of the audio object in channels in the first configuration will be rendered in channels with predetermined positions differing from the predetermined positions of the specific subset of the plurality of channels from which the object was extracted, and determining whether the risk exceeds a threshold, a converting stage arranged for, in response to the risk estimating stage determining that the risk does not exceed the threshold, including the audio object and metadata comprising the spatial position of the audio object in the output audio object content.

EEE 18. A method for processing a time frame of audio content having a spatial position, comprising the steps of:

determining the spatial position of the audio content, determining a distance value by comparing the spatial position of the audio content to a predetermined area, wherein the spatial position of the audio content is a coordinate in 3D having an x component, a y component and a z component, wherein a possible range of the spatial position of the audio content is $0<=x<=1$, $0<=y<=1$ and $0<=z<=1$, wherein the predetermined area corresponds to coordinates in the range of $0<=x<=1$, $y=0$ and $0<=z<=1$, wherein the step of determining a distance value comprises using the y component of the spatial position as the distance value, determining, at least based on the spatial position of the audio content, whether properties of the audio content should be adjusted, upon determining that properties of the audio content should be adjusted, receiving a control value, and adjusting at least one of the spatial position and an energy level of the audio content at least based on the distance value and the control value.

EEE 19. The method of EEE 18, wherein the properties of the audio content is determined to be adjusted if the distance value does not exceed a threshold value, wherein upon determining that properties of the audio content should be adjusted, the spatial position is adjusted at least based on the distance value and on the x-value of the spatial position.

EEE 20. The method of EEE 19, wherein the step of adjusting the spatial position comprises adjusting the z value of the spatial position based on the x-value of the spatial position and adjusting the y value of the spatial position based on the x value of the spatial position.

EEE 21. The method of EEE 18, wherein the properties of the audio content is determined to be adjusted only if the distance value exceeds a threshold value, wherein upon determining that properties of the audio content should be adjusted, the energy level is adjusted at least based on the distance value and on the z-value of the spatial position.

EEE 22. The method of EEE 21, further comprising the step of, prior to the step of determining whether properties of the audio content should be adjusted, determining a current energy level of the time frame of the audio content, wherein the energy level is adjusted also based on the current energy level.

EEE 23. The method of EEE 22, wherein the properties of the audio content is determined to be adjusted only if the current energy level does not exceed a threshold energy level.

EEE 24. The method of any one of EEE 21-23, further comprises receiving an energy adjustment parameter pertaining to a previous time frame of the audio content, wherein the energy level is adjusted also based on the energy adjustment parameter.

EEE 25. The method of EEE 18, wherein the properties of the audio content is determined to be adjusted only if the distance value exceeds a threshold value, wherein the z value of the spatial position is adjusted based on the distance value.

EEE 26, The method of EEE 25, wherein the z value is adjusted to first value for a first distance value, and to a second value lower than the first value for a second distance value being lower than the first distance value.

EEE 27. A computer program product comprising a computer-readable storage medium with instructions adapted to carry out the method of any one of EEEs 18-26 when executed by a device having processing capability.

EEE 28. A device for processing a time frame of an audio content, comprising a processor arranged to:

determine a spatial position of the audio content, determine a distance value by comparing the spatial position of the audio content to a predetermined area, wherein the spatial position of the audio content is a coordinate in 3D having an x component, a y component and a z component, wherein a possible range of the spatial position of the audio content is 0<=x<=1, 0<=y<1 and 0<=z<=1, wherein the predetermined area corresponds to coordinates in the range of 0<=x<=1, y=0 and 0<=z<=1, wherein the distance value is determined using the y component of the spatial position as the distance value, determine, at least based on the spatial position of the audio content, whether properties of the audio content should be adjusted, upon determining that properties of the audio content should be adjusted, the processor is arranged to receive a control value and adjust at least one of the spatial position and an energy level of the audio content at least based on the distance value and the control value.

What is claimed is:

1. A method for converting a time frame of a multichannel audio signal into output audio content comprising audio objects, metadata comprising a spatial position for each audio object, and bed channels, wherein the multichannel audio signal comprises a plurality of channels in a first configuration, each channel in the first configuration having a predetermined position pertaining to a loudspeaker setup and defined in a predetermined coordinate system, the method comprising the steps of: a) receiving the time frame of the multichannel audio signal, b) extracting at least one audio object from the time frame of the multichannel audio signal, the audio object being extracted from a specific subset of the plurality of channels, and for each audio object of the at least one audio object: c) estimating a spatial position of the audio object, d) based on the spatial position of the audio object, estimating a risk that a rendered version of the audio object in channels in the first configuration will be rendered in channels with predetermined positions differing from the predetermined positions of the specific subset of the plurality of channels from which the object was extracted, e) determining whether the risk exceeds a threshold, and f) upon determining that the risk does not exceed the threshold, include the audio object and metadata comprising the spatial position of the audio object in the output audio content.

2. The method of claim 1, further comprising, upon determining that the risk exceeds the threshold: rendering at least a fraction of the audio object to the bed channels.

3. The method of claim 1, wherein the step of estimating a risk comprises the step of: comparing the spatial position of the audio object to a predetermined area, wherein the risk is determined to exceed the threshold if the spatial position is within the predetermined area.

4. The method of claim 3, wherein the predetermined area comprises a first sub area, and the method further comprises the step of: determining a fraction value corresponding to a fraction of the audio object to be included in the output audio content based on a distance between the spatial position and the first sub area, wherein the value is a number between zero and one, wherein if the fraction value is determined to be more than zero, the method further comprises: multiplying the audio object with the fraction value to achieve a fraction of the audio object, and including the fraction of the audio object and metadata comprising the spatial position of the audio object in the output audio content.

5. The method of claim 4, wherein the step of determining a fraction value is performed upon determining that the risk exceeds the threshold.

6. The method of claim 4, wherein the fraction value is determined to be 0 if the spatial position is in the first sub area, is determined to be 1 if the spatial position is not in the predetermined area, and is determined to be between 0 and 1 if the spatial position is in the predetermined area but not in the first sub area.

7. The method of claim 3, wherein the predetermined area includes the predetermined positions of at least some of the plurality of channels in the first configuration.

8. The method of claim 7, wherein the first configuration corresponds to a 5.1-channel set-up or a 7.1-channel set-up, and wherein the predetermined area includes the predetermined positions of a front left channel, a front right channel, and a center channel in the first configuration.

9. The method of claim 8, wherein the predetermined positions of the front left front right and center channels share a common value of a given coordinate in the predefined coordinate system, wherein the predetermined area includes positions having a value of the given coordinate up to a threshold distance away from said common value of the given coordinate.

10. The method of claim 1, wherein the step of extracting at least one audio object from the multichannel audio signal comprises, for each extracted audio object, computing a first set of energy levels, each energy level corresponding to a specific channel of the plurality of channels of the multichannel audio signal and indicating an energy level of audio content of the audio object that was extracted from the specific channel, wherein the step of estimating a risk comprises the steps of: using the spatial position of the audio object, rendering the audio object to a second plurality of channels in the first configuration and computing a second set of energy levels based on the rendered object, each energy level corresponding to a specific channel of the second plurality of channels in the first configuration and indicating an energy level of audio content of the audio object that was rendered to the specific channel of the second plurality of channels, calculating a difference between the first set of energy levels and the second set of energy levels, and estimating the risk based on the difference.

11. The method of claim 10, wherein the step of calculating a difference between the first set of energy levels and the second set of energy levels comprises: using the first set of energy levels, rendering the audio object to a third plurality of channels in the first configuration, for each pair of corresponding channels of the third and second plurality of channels, measuring a Root-Mean-Square, RMS, value of each of the pair of channels, determining an absolute difference between the two RMS values, and calculate a sum of the absolute differences for all pairs of corresponding channels of the third and second plurality of channels, wherein the step of determining whether the risk exceeds a threshold comprises comparing the sum to the threshold.

12. The method of claim 1, wherein the step of extracting at least one audio object from the multichannel audio signal comprises, for each extracted audio object, computing a first set of energy levels, each energy level corresponding to a specific channel of the plurality of channels of the multichannel audio signal and indicating an energy level of audio content of the audio object that was extracted from the specific channel, the method further comprising the step of: upon determining that the risk exceeds the threshold, using the first set of energy levels for rendering the audio object to the output bed channels.

13. The method of claim 12, further comprising the steps of: multiplying the audio object with 1 minus the fraction value to achieve a second fraction of the audio object, and using the first set of energy levels for rendering the second fraction of the audio object to the output bed channels.

14. The method of claim 1, further comprising, upon determining that the risk exceeds the threshold, the step of including in the output audio content: the audio object, metadata comprising the spatial position of the audio object and additional metadata, wherein the additional metadata is configured so that it can be used at a rendering stage to ensure that the audio object is rendered in channels in the first configuration with predetermined positions corresponding to the predetermined positions of the specific subset of the plurality of channels from which the object was extracted.

15. The method of claim 1, further comprising the step of: including in the output audio content: the audio object, metadata comprising the spatial position of the audio object and additional metadata, wherein the additional metadata indicates at least one from the list of: the specific subset of the plurality of channels from which the object was extracted, at least one channel of the plurality of channels which is not included in the specific subset of the plurality of channels from which the object was extracted, and a divergence parameter.

16. The method of claim 15, wherein the additional metadata is included in the output audio content only upon determining that the risk exceeds the threshold.

17. The method of claim 15, wherein the step of extracting at least one audio object from the multichannel audio signal comprises, for each extracted audio object, computing a first set of energy levels, each energy level corresponding to a specific channel of the plurality of channels of the multichannel audio signal and indicating an energy level of audio content of the audio object that was extracted from the specific channel, wherein the additional metadata comprises the first set of energy levels.

18. A computer program product comprising a non-transitory computer-readable storage medium with instructions adapted to carry out the method of claim 1 when executed by a device having processing capability.

19. A device for converting a time frame of a multichannel audio signal into output audio content comprising audio objects, metadata comprising a spatial position for each audio object, and bed channels, wherein the multichannel audio signal comprises a plurality of channels in a first configuration, each channel in the first configuration having a predetermined position pertaining to a loudspeaker setup and defined in a predetermined coordinate system, the device comprises: a receiving stage arranged for receiving the time frame of the multichannel audio signal, an object extraction stage arranged for extracting an audio object from the time frame of the multichannel audio signal, wherein the audio object being extracted from a specific subset of the plurality of channels, a spatial position estimating stage arranged for estimating a spatial position of the audio object, a risk estimating stage arranged for, based on the spatial position of the audio object, estimating a risk that a rendered version of the audio object in channels in the first configuration will be rendered in channels with predetermined positions differing from the predetermined positions of the specific subset of the plurality of channels from which the object was extracted, and determining whether the risk exceeds a threshold, and a converting stage arranged for, in response to the risk estimating stage determining that the risk does not exceed the threshold, including the audio object and metadata comprising the spatial position of the audio object in the output audio content.

* * * * *